US009889672B2

(12) United States Patent
Kobayashi et al.

(10) Patent No.: US 9,889,672 B2
(45) Date of Patent: Feb. 13, 2018

(54) ATTACHMENT, LIQUID CONTAINER, AND LIQUID SUPPLY APPARATUS

(71) Applicant: SEIKO EPSON CORPORATION, Tokyo (JP)

(72) Inventors: Atsushi Kobayashi, Nagano-ken (JP); Hitotoshi Kimura, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/509,545

(22) Filed: Oct. 8, 2014

(65) Prior Publication Data

US 2016/0101628 A1 Apr. 14, 2016

Related U.S. Application Data

(60) Division of application No. 14/048,247, filed on Oct. 8, 2013, now Pat. No. 8,882,249, which is a division
(Continued)

(30) Foreign Application Priority Data

Feb. 2, 2005 (JP) ..... 2005-025985
Feb. 2, 2005 (JP) ..... 2005-025986
Feb. 18, 2005 (JP) ..... 2005-042589

(51) Int. Cl.
*B41J 2/195* (2006.01)
*B41J 2/175* (2006.01)

(52) U.S. Cl.
CPC ..... *B41J 2/17523* (2013.01); *B41J 2/175* (2013.01); *B41J 2/17509* (2013.01);
(Continued)

(58) Field of Classification Search
USPC ..... 347/7, 50, 85, 86
See application file for complete search history.

(56) References Cited

U.S. PATENT DOCUMENTS 5,485,187 A * 1/1996 Okamura ..... B41J 2/175 347/85
5,856,840 A 1/1999 Barinaga et al.
(Continued)

FOREIGN PATENT DOCUMENTS

CN 2543709 Y 4/2003
EP 0965451 A2 12/1999
(Continued)

OTHER PUBLICATIONS

Extended European Search Report dated Jan. 18, 2013 in European Patent Application No. 11175005.5.
(Continued)

*Primary Examiner* — Lam Nguyen
(74) *Attorney, Agent, or Firm* — Foley & Lardner LLP

(57) ABSTRACT

An attachment is mounted on a cartridge holder of a printer as a replacement of an ink cartridge. An ink outlet member having a link passage is separably secured to an attachment body. Ink is supplied from the exterior to the ink outlet member through an ink supply tube. When the attachment is mounted on the cartridge holder, a downstream end of the ink outlet member is positioned with respect to and connected to an ink supply needle of the printer. Accordingly, the attachment is easily and quickly installed in a liquid ejection apparatus. This reduces costs and makes it easy to use the attachment.

9 Claims, 14 Drawing Sheets

Related U.S. Application Data of application No. 13/187,925, filed on Jul. 21, 2011, now Pat. No. 8,579,413, which is a continuation of application No. 12/426,780, filed on Apr. 20, 2009, now Pat. No. 8,007,084, which is a continuation of application No. 11/344,825, filed on Feb. 1, 2006, now Pat. No. 7,677,710.

(52) U.S. Cl.
CPC ..... *B41J 2/17513* (2013.01); *B41J 2/17553* (2013.01); *B41J 2002/17516* (2013.01)

(56) References Cited

U.S. PATENT DOCUMENTS

| | | | | |
|---|---|---|---|---|
| 5,912,688 | A | 6/1999 | Gragg | |
| 6,116,723 | A | 9/2000 | Childers | |
| 6,183,071 | B1 * | 2/2001 | Sugimoto | B41J 2/175 347/7 |
| 6,234,615 | B1 | 5/2001 | Tsukuda | |
| 6,243,115 | B1 | 6/2001 | Baker et al. | |
| 6,286,949 | B1 | 9/2001 | Lewis et al. | |
| 6,290,343 | B1 | 9/2001 | Lewis et al. | |
| 6,450,631 | B1 | 7/2002 | Hayashi et al. | |
| 6,431,693 | B2 | 8/2002 | Eida | |
| 6,471,343 | B1 | 10/2002 | Shimizu et al. | |
| 6,612,689 | B2 * | 9/2003 | Suenaga | B41J 2/17509 347/85 |
| 6,726,313 | B1 | 4/2004 | Oda et al. | |
| 6,796,627 | B2 | 9/2004 | Kimura et al. | |
| 6,805,438 | B2 | 10/2004 | Kaga et al. | |
| 6,834,945 | B2 | 12/2004 | Ishizawa et al. | |
| 7,144,104 | B2 | 12/2006 | Katayama | |
| 7,677,710 | B2 | 3/2010 | Kobayashi et al. | |
| 8,579,413 | B2 | 11/2013 | Kobayashi et al. | |
| 2002/0003561 | A1 | 1/2002 | Ishitsu et al. | |
| 2002/0024552 | A1 * | 2/2002 | Suzuki | B41J 2/175 347/36 |
| 2002/0196312 | A1 | 12/2002 | Ishizawa et al. | |
| 2002/0196318 | A1 | 12/2002 | Shimizu | |
| 2003/0007045 | A1 | 1/2003 | Yoshida et al. | |
| 2003/0038865 | A1 | 2/2003 | Inamura | |
| 2003/0076391 | A1 | 4/2003 | Wilson et al. | |
| 2003/0128256 | A1 | 7/2003 | Oda et al. | |
| 2003/0218660 | A1 | 11/2003 | Matsumoto et al. | |
| 2004/0046842 | A1 * | 3/2004 | Rhee | B41J 2/17509 347/85 |
| 2004/0145634 | A1 | 7/2004 | Thielman et al. | |
| 2012/0212526 | A1 * | 8/2012 | Karasawa | B41J 2/17509 347/7 |

FOREIGN PATENT DOCUMENTS

| | | | |
|---|---|---|---|
| EP | 1270237 | A2 | 1/2003 |
| JP | 56-36437 | U | 4/1981 |
| JP | 10-024613 | A | 1/1998 |
| JP | 11-048493 | A | 2/1999 |
| JP | 2001-063091 | A | 3/2001 |
| JP | 2001-212974 | A | 8/2001 |
| JP | 2001-287380 | A | 10/2001 |
| JP | 2002-019140 | A | 1/2002 |
| JP | 2002-0191140 | A | 1/2002 |
| JP | 2002-513340 | A | 5/2002 |
| JP | 2003-127427 | A | 5/2003 |
| JP | 2003-211689 | A | 7/2003 |
| JP | 2003-311997 | A | 11/2003 |
| JP | 2003-326732 | A | 11/2003 |
| JP | 2004-142405 | A | 5/2004 |
| JP | 2004-203055 | A | 7/2004 |
| JP | 2004-306496 | A | 11/2004 |
| WO | 98/55318 | A1 | 12/1998 |

OTHER PUBLICATIONS

Extended European Search Report dated Feb. 2, 2011 in European Patent Application No. 06712781.1.

Japanese Office Action dated Sep. 28, 2010 in Japanese Patent Application No. 2005-025985.

Japanese Office Action dated Jun. 8, 2010 in Japanese Patent Application No. 2005-025986.

International Search Report and Written Opinion of the International Searching Authority dated Aug. 16, 2007 for International Application No. PCT/JP2006/301638 and the English translation.

* cited by examiner

ATTACHMENT, LIQUID CONTAINER, AND LIQUID SUPPLY APPARATUS

CROSS-REFERENCE TO RELATED APPLICATIONS

This application is a divisional of co-pending U.S. patent application Ser. No. 14/048,247 filed on Oct. 8, 2013, which is a divisional of co-pending U.S. patent application Ser. No. 13/187,925 filed on Jul. 21, 2011, which is a continuation U.S. patent application Ser. No. 12/426,780 filed on Apr. 20, 2009, now U.S. Pat. No. 8,007,084, which is a continuation of U.S. patent application Ser. No. 11/344,825, now U.S. Pat. No. 7,677,710 which was filed on Feb. 1, 2006 and is based upon and claims the benefit of priority from prior Japanese Patent Applications No. 2005-025985, filed on Feb. 2, 2005, No. 2005-025986, filed also on Feb. 2, 2005, and No. 2005-042589, filed on Feb. 18, 2005, the entire contents of each of which are incorporated herein by reference.

BACKGROUND OF THE INVENTION

The present invention relates to attachments and liquid supply apparatuses that are preferably used in liquid ejection apparatuses. The present invention also relates to liquid containers and liquid supply apparatuses, and, more particularly, to liquid containers and liquid supply apparatuses that replace liquid cartridges in a liquid ejection apparatus, such as an inkjet recording apparatus, and allow supply of a liquid, such as ink, from an external source.

For example, an inkjet recording apparatus (a liquid ejection apparatus) typically includes an inkjet recording head (a liquid ejecting portion) and a paper feeder mechanism. The recording head is formed in a carriage and thus moved in a direction defined by the width of a sheet of recording paper. The paper feeder mechanism moves the paper sheet in a direction perpendicular to the movement direction of the recording head and relative to the recording head. The paper sheet is thus subjected to recording through ejection of ink droplets from the recording head in accordance with printing data.

If the inkjet recording apparatus is used on business, the apparatus must tolerate relatively large work load. It is thus necessary to employ a corresponding large-capacity cartridge. To meet such need, an off-carriage type recording apparatus including small-capacity sub tanks and main tanks serving as cartridges is known. The sub tanks are installed in the carriage in which the recording head is provided. The main tanks are arranged in a mounting portion (a cartridge holder), which is formed at, for example, a side of the body of the recording apparatus. Ink is supplied from each of the main tanks to the associated one of the sub tanks through an ink tube. The ink is then sent from the sub tanks to the recording head.

Further, to perform printing on a large-sized sheet of paper, it is now required to provide a large-sized recording apparatus that has an increased scanning distance of a carriage. The recording apparatus includes an increased quantity of nozzles formed in a recording head, thus improving the throughput of the apparatus.

To further improve the throughput of the apparatus, it is desirable that ink be fed from main tanks to sub tanks formed in a carriage when necessary while printing is being performed. The ink is thus stably supplied to the recording head through the sub tanks.

In this apparatus, each of the main tanks is connected to the corresponding one of the sub tanks through an ink supply tube provided specifically for each of the ink types employed by the apparatus. However, since the scanning distance of the carriage is relatively great in this apparatus, the length of each ink supply tube is increased and thus pressure variation occurs in the ink supply tube. Further, since the recording head includes the increased number of the nozzles, as has been described, the apparatus consumes an increased amount of ink. This raises the dynamical pressure of the ink in each ink supply tube, which connects the associated main tank to the sub tank. The amount of the ink supplied to the sub tank thus may become insufficient.

To solve this problem, for example, an inkjet recording apparatus having an ink supply valve unit, which includes a movable valve, has been proposed (see, for example, Japanese Laid-Open Patent Publication No. 2004-142405). The ink supply valve unit selectively opens and closes the valve in order to connect or disconnect an ink supply chamber with respect to a pressure chamber. The ink supply valve unit receives the ink that is to be supplied from a cartridge to a liquid ejection head, thus eliminating pressure variation in an ink supply tube.

Alternatively, for example, a structure in which air pressure is applied to a main tank has been proposed (see, for example, Japanese Laid-Open Patent Publications Nos. 2001-212974, 2001-287380, and 2003-311997). In this structure, an ink flow from the main tank to a sub tank is forcibly produced by the air pressure. A sufficient amount of ink free from pressure variation is thus supplied to the sub tank.

FIG. 24 is a view schematically showing a typical inkjet recording apparatus in which air pressure is applied to a main tank. FIG. 25 shows the structure of a cartridge 18 serving as the main tank.

As shown in FIG. 24, a recording head 15, a sub tank 103, a pressurization pump 20, and a cartridge holder 17 are formed in a printer 301. The cartridge holder 17 accommodates a cartridge 18 filled with ink Ik.

As is shown in detail in FIG. 25, the cartridge 18 includes a casing 39, which is a sealed casing formed of hard resin, and an ink pack 42 formed of flexible material. The ink pack 42 is received in the casing 39. An air inlet port 46 and a liquid outlet port 44 are defined in an end of the casing 39. Pressurized air is introduced from an external source to the ink pack 42 through the air inlet port 46. The pressurized air thus pressurizes and sends the ink Ik from the ink pack 42 to the exterior through the liquid outlet port 44. When the cartridge 18 is accommodated in the cartridge holder 17 of the printer 301, the liquid outlet port 44 and the air inlet port 46 are connected to the sub tank 103 and the pressurization pump 20, respectively.

Since the conventional cartridge 18 is supposed to be accommodated in the cartridge holder 17 of the printer 301, the size of the cartridge 18 is restricted correspondingly. A large-sized cartridge is thus actually unusable. In other words, the cartridge holder that accommodates the cartridge is formed in a restricted space in the printer. The amount of the ink retained in the cartridge is thus typically small. Thus, the greater the work load of the printer becomes, the more often the cartridge must be replaced. This complicates operation of the printer and raises the running cost of the printer. Particularly, if the printer is a small-sized type or a thin type and the space for accommodating the cartridge holder is restricted, the amount of the ink retained in the cartridge becomes correspondingly small. In this case, the above-described problem is pronounced.

Therefore, if the capacity of the cartridge must be increased, an external tank may be employed as an option for supplying the ink the external tank to the printer.

However, there may be a case in which the external tank for feeding the ink Ik is not compatible with a pressurization supply system of the ink Ik through the pressurization pump 20 of the printer 301. In this case, the printer 301 may cause an error in operation.

As described in Japanese Laid-Open Patent Publication No. 2003-326732, for example, an ink supply system using an attachment has been proposed. The attachment is mounted on a cartridge holder in the same manner as a cartridge, when the work load of the printer is relatively great. The ink is supplied from an external large-capacity ink tank to a recording head through the attachment. More specifically, a hollow sub tank is defined in the attachment, which is mounted on the cartridge holder. With the attachment mounted on the cartridge holder, the ink is introduced out of the external tank to the sub tank of the attachment to a predetermined level through actuation of a pump associated with the attachment. The ink is then sent from a liquid outlet port defined in a lower portion of the attachment to a liquid inlet port defined in the recording head.

However, when mounting the attachment of Japanese Laid-Open Patent Publication No. 2003-326732 on the cartridge holder, the pump must be activated to depressurize the sub tank of the attachment to a negative level. The ink is thus sent from the external tank to the sub tank until the ink level in the sub tank reaches the predetermined level. This prolongs the time needed for accomplishing the procedure for mounting the attachment. Further, it is necessary to install the pump, which sends the ink from the external tank to the sub tank, in association with the attachment. The cost for providing the attachment thus increases. That is, the attachment of Japanese Laid-Open Patent Publication No. 2003-326732 complicates the procedure for mounting the attachment on the cartridge holder as a replacement of the cartridge and increases the cost. In this regard, the attachment is not necessarily easy to employ.

SUMMARY

Accordingly, it is an objective of the present invention to provide low-cost and easy-to-use attachment and liquid supply apparatus that are easily and quickly mounted on a liquid ejection apparatus.

It is another objective of the present invention to provide a liquid container and a liquid supply apparatus that are compatible with a liquid pressurization supply system through an air pressurizing portion of a liquid ejection apparatus and stabilize supply of liquid.

To achieve the foregoing objectives, one aspect of the invention provides an attachment that is mountable on a liquid ejection apparatus. A liquid retainer is detachably mounted on a mounting portion of the liquid ejection apparatus. The mounting portion has a liquid inlet portion through which a liquid is introduced from the liquid retainer. The liquid is supplied from the exterior of the liquid ejection apparatus to the attachment through a liquid supply passage. The attachment includes an attachment body that is mountable on the mounting portion as a replacement of the liquid retainer, and a link portion that defines a link passage. The link portion is arranged in the attachment body in such a manner that, when the attachment body is mounted on the mounting portion, a downstream end of the link passage is positioned with respect to and connected to the liquid inlet portion. A downstream end of the liquid supply passage is connectable to an upstream end of the link passage of the link portion.

Another aspect of the present invention provides a liquid container that is mountable on a mounting portion of a liquid ejection apparatus. The liquid ejection apparatus has a liquid ejecting portion and an air pressurizing portion. The liquid container includes an air inlet port, a liquid outlet port, a liquid supply port, and a check valve. Through the air inlet port, a pressurized air is introduced from the exterior. The air inlet port is connected to the air pressurizing portion when the liquid container is mounted on the mounting portion. The liquid outlet port is connected to the liquid ejecting portion when the liquid container is mounted on the mounting portion. When an air is introduced into the liquid container through the air inlet port, a liquid is sent from the liquid container to the liquid ejecting portion through the liquid outlet port by a pressure generated by the air. Through the liquid supply port, the liquid is supplied to the liquid container. The check valve is provided in the liquid supply port. The check valve becomes open when an external pressure of the liquid supply port is greater than an internal pressure of the liquid supply port, and is closed when the internal pressure is greater than the external pressure.

A further aspect of the present invention provides a liquid supply apparatus that supplies a liquid to a liquid ejection apparatus. The liquid ejection apparatus has a liquid ejecting portion, an air pressurizing portion, and a mounting portion. A liquid cartridge is mountable on the mounting portion. The liquid cartridge has a first air inlet port and a first liquid outlet port. Liquid retained in the liquid cartridge is sent to the exterior from the first liquid outlet port by a pressure generated by a pressurized air when the pressurized air is introduced into the liquid cartridge through the first air inlet port. The liquid supply apparatus includes an attachment, an external tank, a tubular passage, and a pressure adjusting portion. The attachment is mountable on the mounting portion as a replacement of the liquid cartridge. The attachment has a second liquid outlet port and a second air inlet port. When the attachment is mounted on the mounting portion, the second liquid outlet port is connected to the liquid ejecting portion and the second air inlet port is connected to the air pressurizing portion. The external tank retains a liquid supply. The tubular passage connects the external tank to the second liquid outlet port. The liquid supply is supplied from the external tank to the second liquid outlet port through the tubular passage. The pressure adjusting portion adjusts a supply pressure of the liquid supply. The pressure adjusting portion also adjusts the supply pressure in correspondence with an air pressure introduced from the air pressurizing portion through the second air inlet port.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A first embodiment of the present invention will now be described with reference to FIGS. 1 to 6.

Figure 1:
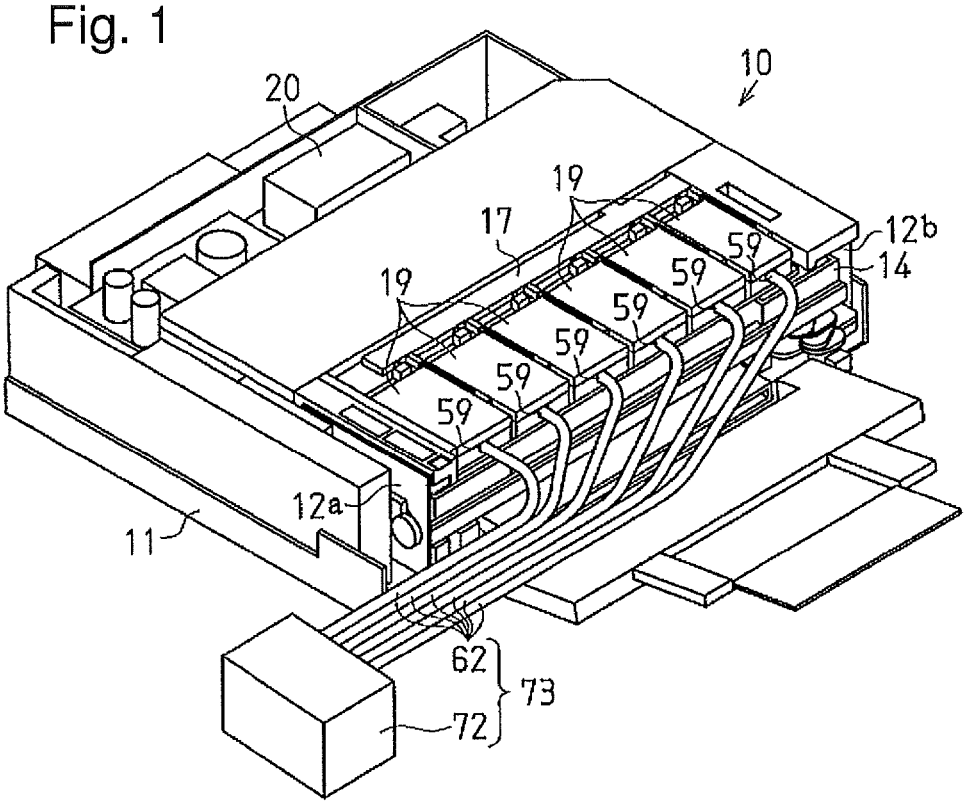
FIG. 1 is a perspective view showing a printer according to a first embodiment of the present invention.
Figure 2:
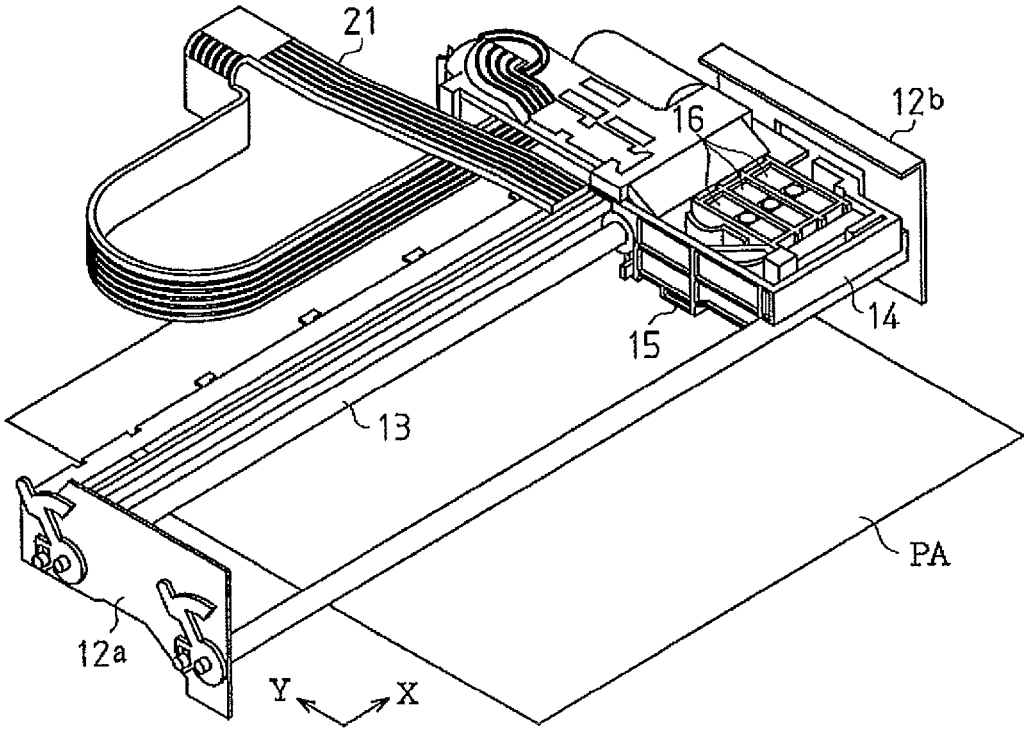
FIG. 2 is a perspective view showing a main portion of the printer of FIG. 1.

As shown in FIGS. 1 and 2, an inkjet printer (hereinafter, a "printer") 10, or a liquid ejection apparatus of the first embodiment, includes a substantially box-like body casing 11. A pair of opposing frame members 12*a*, 12*b* are provided at opposing lateral sides of the body casing 11. A rod-like guide shaft 13 extends between the frame members 12*a*, 12*b*. A carriage 14 is movably passed through the guide shaft 13. The carriage 14 is thus reciprocated in a direction (a main scanning direction X of FIG. 2) along the longitudinal direction of the guide shaft 13 while driven by the drive force generated by a non-illustrated carriage motor provided in the printer 10.

A recording head 15 is formed on a bottom surface of the carriage 14 as a liquid ejection head. A plurality of nozzles (not shown) are defined in the recording head 15 for ejecting ink as liquid. Valve units 16 are arranged on an upper surface of the carriage 14 and supply the ink under an adjusted pressure to the recording head 15. In the first embodiment, three valve units 16 are provided in the carriage 14. Each of the valve units 16 adjusts the pressures of two color inks and supplies the ink to the recording head 15. In other words, six color inks (black, yellow, magenta, cyan, light cyan, light magenta, and light cyan inks) are fed to the recording head 15.

A platen (not shown), or a paper feeding portion, extends parallel with the guide shaft 13 below the zone in which the carriage 14 moves between the frame members 12*a*, 12*b* of the body casing 11. The platen sends a recording paper PA as a target in a sub scanning direction Y (see FIG. 2) perpendicular to the main scanning direction X. By ejecting ink droplets onto the recording paper PA, which is moved in the sub scanning direction Y, through the ejection nozzles of the recording head 15, the printer 10 of the first embodiment performs printing.

A cartridge holder 17, or a mounting portion, is provided in a fixed manner (fixed in an immovable manner) above the zone in which the carriage 14 moves between the frame members 12*a*, 12*b* of the body casing 11. The cartridge holder 17 holds cartridges as liquid retainers (hereinafter, "cartridges") 18 of FIGS. 4A, 4B or attachments 19 of FIG. 5. The cartridges 18 and the attachments 19 are mutually replaceable. In FIG. 1, six attachments 19 are mounted on the cartridge holder 17 of the printer 10.

As shown in FIG. 1, a pressurization pump 20 is arranged in a rear portion of the body casing 11. A belt-like tube ribbon 21 formed of flexible material extends in the body casing 11 and passes through the vicinity of the pressurization pump 20. The tube ribbon 21 connects the valve units 16 to the cartridge holder 17 (see FIG. 2). The tube ribbon 21 includes six ink passages, or liquid passages, and a single air passage, or a gas passage. Each of the ink passages supplies the ink from the corresponding cartridge 18 (or the attachment 19) mounted on the cartridge holder 17 to the associated valve unit 16. The air passage sends pressurized air from the pressurization pump 20 to the cartridges 18 (or the attachments 19), which are held by the cartridge holder 17.

Figure 3:
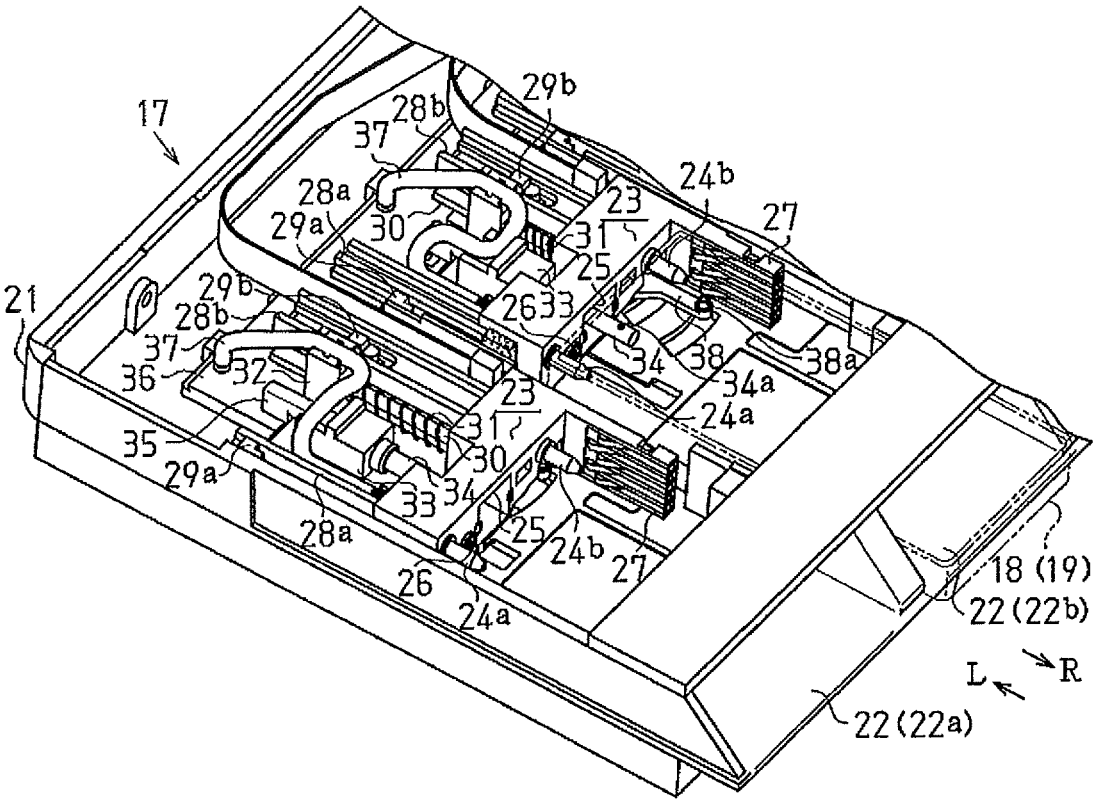
FIG. 3 is a partially exploded perspective view showing a cartridge holder of FIG. 1.

As shown in FIG. 3, the cartridge holder 17 has a box-like holder casing 17*a* that encompasses the outer circumference of the cartridge holder 17. A plurality of (six, in the first embodiment) sockets 22 are defined in the interior of the holder casing 17*a* for receiving the cartridges 18 (or the attachments 19). In FIG. 3, two of the sockets 22 are illustrated (while the socket 22*a* located on the near side is empty, the socket 22*b* located on the far side is occupied by the cartridge 18 (or the attachment 19)). When mounting the cartridge 18 (the attachment 19) on the cartridge holder 17, the cartridge 18 (the attachment 19) is inserted into the corresponding socket 22 in an insert direction indicated by arrow L of FIG. 3. When detaching the cartridge 18 (the attachment 19) from the cartridge holder 17, the cartridge 18 (the attachment 19) is retracted from the socket 22 in a retract direction indicated by arrow R of FIG. 3.

A substantially parallelepiped slider 23 is arranged in each of the sockets 22. The lateral width of the slider 23 coincides with a substantially entire lateral width of the socket 22. A pair of positioning projections 24*a*, 24*b* project from positions close to opposing lateral ends of a front surface (a surface located foremost in direction R of FIG. 3) of each slider 23. A through hole 25 having a rectangular cross-sectional shape is defined between the positioning projections 24*a*, 24*b* and extends in the front-rear direction of the slider 23. An air outlet port 26 having a circular cross-sectional shape is defined between the through hole 25 and the positioning projection 24*a* (as viewed to the left in FIG. 3) and extends in the front-rear direction of the slider 23. A terminal portion 27 having a plurality of contacts (not shown) extends forward from the opposing end of the front surface of the slider 23 (as viewed to the right in FIG. 3).

A pair of rails 28*a*, 28*b* extend rearward from positions close to the opposing lateral ends of a rear surface (a surface located foremost in direction L of FIG. 3) of each slider 23. Support guides 29*a*, 29*b* are fixed to a bottom surface of each socket 22. The rails 28*a*, 28*b* are allowed to slide along the support guides 29*a*, 29*b* in the front-rear direction of the slider 23. A rod-like shaft 30 projects rearward from the rear surface of each slider 23 at a position between the through hole 25 and the rail 28*b* (as viewed to the right in FIG. 3).

A coil spring 31 is loosely wound around the shaft 30 of each slider 23. An end (a rear end) of the coil spring 31 is engaged with an engagement projection 32 fixed to the bottom surface of the socket 22. An opposing end (a front end) of the coil spring 31 contacts the rear surface of the slider 23. Thus, the slider 23 is urged normally in the retract direction (indicated by arrow R of FIG. 3) by the force generated by the coil spring 31. In this state, the rails 28*a*, 28*b* are allowed to slide along the support guides 29*a*, 29*b*, thus reciprocating in the front-rear direction.

As shown in FIG. 3, a support table 33 is arranged in a substantial lateral middle of each socket 22. Each of the support tables 33 is located rearward from the zone in which the associated slider 23 is allowed to reciprocate. An ink supply needle 34, or a liquid inlet portion of the printer 10, projects forward from a front surface of the support table 33. Each of the ink supply needles 34 is formed by a pipe through which a liquid passage (not shown) extends. An inlet port 34*a* is defined in a front end portion of the outer circumferential surface of each ink supply needle 34 for introducing the ink into the interior of the ink supply needle 34. As in the upper socket 22*b* in FIG. 3, when the slider 23 is moved rearward against the force of the coil spring 31, the ink supply needle 34 is passed through the through hole 25 of the slider 23 thoroughly from a rear end of the through hole 25 to a front end. In this state, the front end portion of the ink supply needle 34 in which the inlet port 34*a* is defined is projected forward from the front surface of the slider 23.

A connection pipe 35 extends rearward from a rear surface of each support table 33. Each of the connection pipes 35 communicates with the interior of the associated ink supply needle 34 and thus defines a liquid passage. A rear end (a downstream end) of each connection pipe 35 is connected to a connection passage 36, which extends along a substantially entire lateral width of the holder casing 17*a*. The connection passage 36 is formed as an integral body of six ink passages (not shown), each of which defines a liquid passage of the corresponding socket 22, and a single air passage (not shown), which defines a gas passage. Each of the ink passages is connected to the associated one of the ink passages defined in the tube ribbon 21.

Flexible pressurized air supply tubes 37 extend from the air passage of the connection passage 36. A distal end of each of the pressurized air supply tubes 37 is connected to the air outlet port 26 of the corresponding slider 23 from behind. In other words, after having been sent from the pressurization pump 20, the pressurized air is introduced into each pressurized air supply tube 37 through the tube ribbon 21 and the connection passage 36. The pressurized air is then sent forward from the air outlet port 26 of each slider 23.

An engagement lever 38 defining a fixing portion is arranged on a bottom surface of each socket 22, extending in the front-rear direction of the corresponding slider 23 and below the slider 23. A projection 38*a* projects from a front end of each, engagement lever 38. Thus, when the socket 22 receives (accommodates) the cartridge 18 (or the attachment 19) and the slider 23 is retracted, the front end of the corresponding engagement lever 38 from which the projection 38*a* projects is located forward from a front surface of the slider 23. In this state, the projection 38*a*, which projects from the front end of the engagement lever 38, is engaged with an engagement portion 47 formed in the cartridge 18 (see FIG. 4A) or an engagement portion 56 formed in the attachment 19 (see FIG. 5). This immovably holds the cartridge 18 or the attachment 19 in the socket 22.

Next, the cartridge 18 and the attachment 19, which are mutually replaceable and received in each socket 22 of the cartridge holder 17, will be explained. The explanation starts with the cartridge 18 with reference to FIGS. 4A and 4B and proceeds to the attachment 19 with reference to FIG. 5.

Figure 4A:
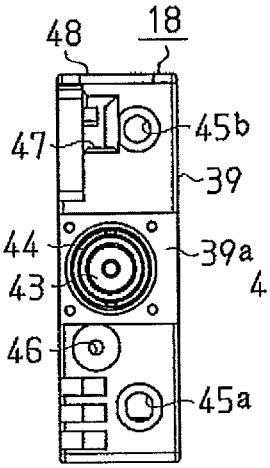
FIG. 4A is a plan view showing a cartridge installed in the cartridge holder of FIG. 1 in a state separated from a lid member.
Figure 4B:
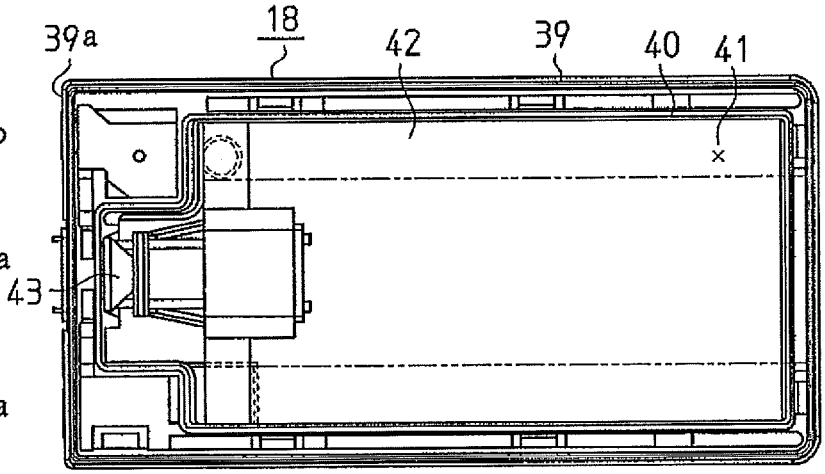
FIG. 4B is a front view showing the cartridge of FIG. 4A.

As shown in FIGS. 4A and 4B, the cartridge 18 includes a box-like casing 39 formed of synthetic resin. An annular wall 40 defines an accommodation chamber (a first air inlet chamber) 41 having a constant volume in the casing 39. The accommodation chamber 41 accommodates an ink pack 42, or a flexible bag, in which the ink is sealed. An ink outlet member 43 is arranged at an end of the ink pack 42 (the left end of the ink pack 42 as viewed in FIG. 4B) as a liquid outlet portion. The ink is thus introduced from the ink pack 42 to the exterior through the ink outlet member 43. Although not illustrated, a valve mechanism (not shown) functioning as a check valve is provided in the ink outlet member 43. The casing 39 is shaped like a non-lidded box with a bottom. The upper opening of the casing 39 is blocked by a lid member (not shown).

A first liquid outlet port 44 functioning as a support port extends through a substantial center of a front surface 39*a* (located forward in the insert direction when the cartridge 18 is inserted (received) in the socket 22) of the casing 39. The first liquid outlet port 44 corresponds to the through hole 25 extending through the slider 23 of the socket 22. Thus, when the cartridge 18 is inserted (accommodated) in the socket 22, the first liquid outlet port 44 is positioned with respect to the through hole 25. The ink outlet member 43 of the ink pack 42, which is accommodated in the casing 39, is inserted in and supported by the first liquid outlet port 44. Therefore, when the cartridge 18 is inserted (accommodated) in the socket 22 and the first liquid outlet port 44 of the casing 39 is positioned with respect to the through hole 25 of the slider 23, the front end of the ink supply needle 34, which projects forward from the through hole 25, is connected to the ink outlet member 43 of the ink pack 42 in a state positioned with respect to the ink outlet member 43.

A pair of positioning recesses 45*a*, 45*b* are defined at positions close to opposing lateral ends of the front surface 39*a* of the casing 39. The positioning recess 45*a* and the positioning recess 45*b* correspond to a positioning projection 24*a* and a positioning projection 24*b*, respectively, each of which is projected from the slider 23 of the socket 22. Thus, when the cartridge 18 is inserted (accommodated) in the socket 22, the positioning recesses 45*a*, 45*b* are positioned with respect to the corresponding positioning projections 24*a*, 24*b*. In this state, the positioning projections 24*a*, 24*b* are fitted in the corresponding positioning recesses 45*a*, 45*b* in such a manner as to restrict movement of the cartridge 18 in a direction crossing the insert direction, thus positioning the cartridge 18.

A first air inlet port 46 is defined in the front surface 39*a* of the casing 39 at a position between the first liquid outlet port,44 and the positioning recess 45*a* (the lower positioning recess as viewed in FIG. 4A). The first air inlet port 46 communicates with the accommodation chamber 41 in which the ink pack 42 is received. The first air inlet port 46 corresponds to the air outlet port 26 extending through, the slider 23 of the socket 22. Thus, when the cartridge 18 is inserted (accommodated) in the socket 22, the first air inlet port 46 is positioned with respect to the air outlet port 26. In this state, the pressurized air that has been supplied from the pressurization pump 20 through the pressurized air supply tube 37 is introduced into the accommodation chamber 41 through the air outlet port 26 and the first air inlet port 46. The ink pack 42 is thus squeezed and deformed by the pressurization force generated by the pressurized air, and the ink in the ink pack 42 moves out of the ink outlet member 43.

An engagement portion 47 is defined at a position closer to the opposing end (the upper end as viewed in FIG. 4A) of the front surface 39*a* of the casing 39 and extends along a bottom surface (the left surface as viewed in FIG. 4A) of the casing 39. The engagement portion 47 is engageable with the engagement lever 38, which is provided in the socket 22 of the cartridge holder 17. A circuit substrate 48 is secured to a portion of the other side surface (the upper surface as viewed in FIG. 4A) of the casing 39 that is closer to the front surface 39*a*. The circuit substrate 48 is connectable to the terminal portion 27, which is projected from the slider 23 of the socket 22. Thus, when the cartridge 18 is inserted (accommodated) in the socket 22, the engagement portion 47 becomes engaged with the engagement lever 38 of the socket 22 and the circuit substrate 48 becomes connected to the terminal portion 27 of the socket 22.

The attachment 19 will hereafter be explained.

Figure 5:
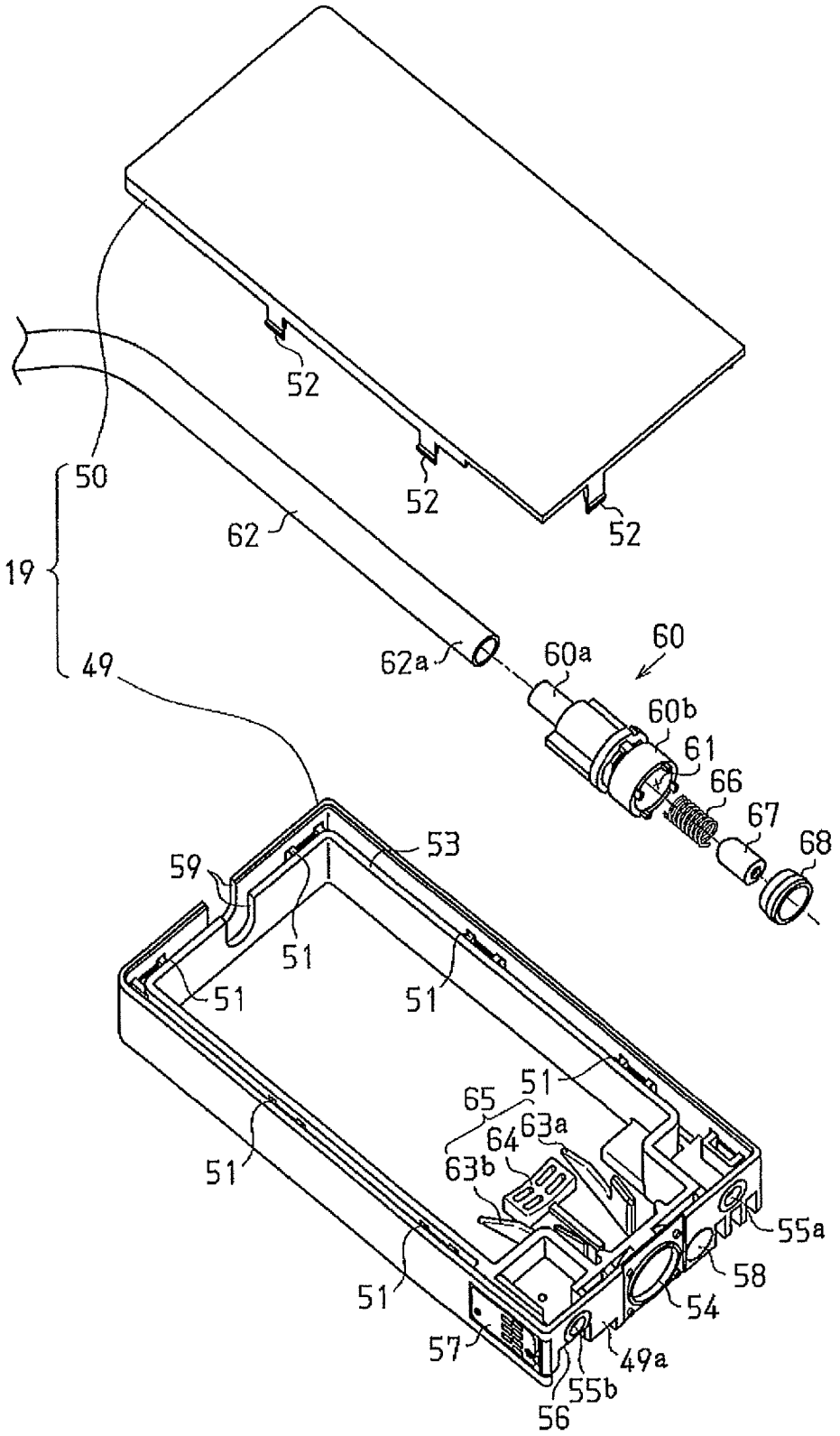
FIG. 5 is an exploded perspective view showing an attachment of FIG. 1.

As shown in FIG. 5, the attachment 19 has an attachment body 49 shaped like a box having a bottom and a lid member 50, which can cover an upper opening defined in the attachment body 49. The attachment body 49 and the lid member 50 include a plurality of engagement recesses 51 and a plurality of engagement pieces 52, respectively. Each of the engagement recesses 51 is defined at a position coinciding with the position at which the corresponding one of the engagement pieces 52 is arranged. The engagement recesses 51 are thus elastically engaged with the corresponding engagement pieces 52. Through such engagement, the lid member 50 is engaged with and held by the attachment body 49.

The attachment body 49 is shaped substantially identical to the casing 39 of the cartridge 18 of FIGS. 4A and 4B. Specifically, an annular wall 53, like the annular wall 40 formed in the casing 39 of the cartridge 18, is provided in the attachment body 49. A second liquid outlet port 54 and a pair of positioning recesses 55*a*, 55*b* are defined in a front surface 49*a* of the attachment body 49 at positions corresponding to the first liquid outlet port 44 and the positioning recesses 45*a*, 45*b*, which are defined in the casing 39 of the cartridge 18. The second liquid outlet port 54 and the positioning recesses 55*a*, 55*b* are configured in the same manner as the first liquid outlet port 44 and the positioning recesses 45*a*, 45*b*, respectively. Further, an engagement portion 56 and a circuit substrate 57 are provided in the attachment body 49 at positions corresponding to the engagement portion 47 and the circuit substrate 48, which are arranged in the casing 39 of the cartridge 18. The engagement portion 56 and the circuit substrate 57 are configured in the same manner as the engagement portion 47 and the circuit substrate 48, respectively.

A blocking portion 58 shaped like a circular seat is formed on the front surface 49*a* of the attachment body 49 at a position corresponding to the first air inlet port 46, which is defined in the front surface 39*a* of the casing 39 of the cartridge 18. In this regard, the attachment body 49 is configured differently from the casing 39 of the carriage 18. Further, unlike the casing 39 of the cartridge 18, the attachment body 49 includes cutout portions 59, or tube support portions. The cutout portions 59 are defined in a portion (a rear portion) of a circumferential wall 49*b* and a corresponding portion of the wall 53 of the attachment body 49.

As has been described, the ink pack 42 is accommodated in the accommodation chamber 41 defined in the casing 39 of the carriage 18. An ink outlet member 60 functioning as a link portion and a liquid outlet member is separably received in the attachment body 49. A passage in which the ink flows, or a link passage 61, extends through the ink outlet member 60. A distal end (a downstream end) 62*a* of an ink tube 62 serving as a flexible ink supply tube (defining a liquid supply passage) is connected to a proximal end 60*a* of the ink outlet member 60, which is an upstream end of the link passage 61.

A support portion 65 is arranged inside the wall 53 of the attachment body 49 and in the vicinity of the second liquid outlet port 54, or a support port, which is defined in the front surface 49*a* of the attachment body 49. The support portion 65 includes a pair of ribs 63*a*, 63*b* and a support seat 64. The ink outlet member 60 is positioned by the support portion 65 with a distal end 60*b* of the ink outlet member 60, or a downstream end of the link passage 61, passed through and supported by the second liquid outlet port 54. The ink outlet member 60 is thus secured to the attachment body 49. In this state, a portion of the ink tube 62 located proximally (upstream) from the distal end (the downstream end) 62*a* is supported by the corresponding cutout portion 59, which is defined in the circumferential wall 49*b* and the wall 53 of the attachment body 49.

A coil spring 66, a stopper 67 for blocking the link passage 61, and an annular packing 68 including a stopper seat (not shown) are incorporated in the link passage 61 at the distal end 60*b* of the ink outlet member 60. The link passage 61 is thus normally held in a closed state by the stopper 67 that is urged toward the packing 68 by the coil spring 66. However, when the attachment body 49 is inserted (accommodated) in the socket 22 of the cartridge holder 17, the front end of the ink supply needle 34 is passed through the second liquid outlet port 54 and thus presses the stopper 67 into the link passage 61 against the urging force of the coil spring 66. This disengages the link passage 61 from the stopper 67 and allows the ink to flow through the link passage 61.

In the attachment 19 constructed as above-described, the attachment body 49 is shaped identically to the casing 39 of the cartridge 18. The second liquid outlet port 54, the positioning recesses 55*a*, 55*b*, the engagement portion 56, and the circuit substrate 57 are arranged in the attachment body 49 at the positions coinciding with the positions of the first liquid outlet port 44, the positioning recesses 45*a*, 45*b*, the engagement portion 47, and the circuit substrate 48 of the casing 39 of the cartridge 18. The attachment 19 is thus mountable to the socket 22 of the cartridge holder 17 in the same manner as the cartridge 18, or replaceable with the cartridge 18.

An ink supply system of the first embodiment will hereafter be explained.

Figure 6:
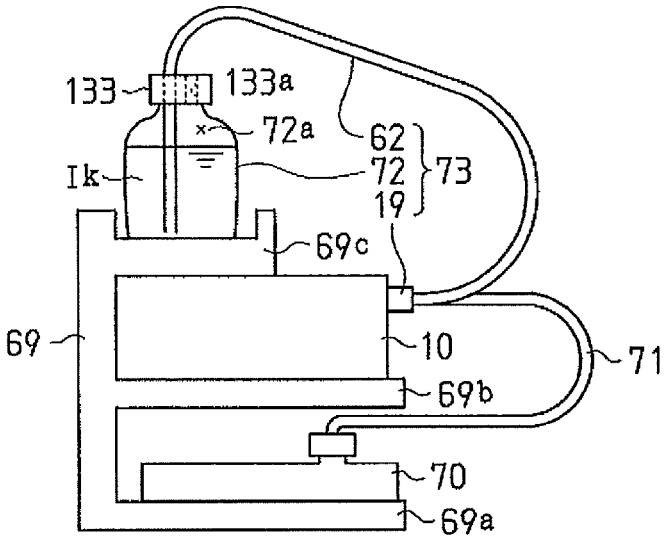
FIG. 6 is a side view showing a liquid supply apparatus arranged with respect to the printer of FIG. 1.

As shown in FIG. 6, in operation, the printer 10 of the illustrated embodiment is mounted on a rack 69 having a multiple-stage structure. The rack 69 includes a lower mounting portion 69*a*, an intermediate mounting portion 69*b*, and an upper mounting portion 69*c*. The printer 10 is mounted on the intermediate mounting portion 69*b*. A waste liquid tank 70, or an external waste liquid collector, is provided on the lower mounting portion 69*a*. A waste liquid tube 71 defining a waste liquid passage connects the waste liquid tank 70 to the printer 10. An upstream end of the waste liquid tube 71 is connected to a waste liquid collector (not shown) provided in the printer 10. After having been drained from the printer 10, waste ink (waste liquid) is sent to the waste liquid tank 70 having an increased capacity, which is located-below the printer 10 and connected to the printer 10 through the waste liquid tube 71.

An external tank 72, or an external retainer retaining a greater volume of ink than the ink pack 42 of each cartridge 18, is mounted on the upper mounting portion 69*c* of the rack 69. An upstream end of the ink tube 62 is introduced into a retainer chamber 72*a*, which is defined in the external tank 72 and retains the ink. A downstream end of the ink tube 62 is connected to the ink outlet member 60 of the attachment 19. The ink is thus supplied from the retainer chamber 72*a* of the external tank 72 to the attachment 19 through the corresponding ink tube 62 due to the difference between the liquid head in the attachment 19 and the liquid head in the retainer chamber 72*a*.

In other words, by arranging the external tank 72 at a position higher than the attachment 19, a difference is ensured between the level of the ink Ik in the external tank 72 and the level of the ink Ik in the attachment 19. The distal end of the corresponding ink tube 62, or a supply tube connected to a liquid supply port 125 of the attachment 19, is passed through a lid 133 secured to the upper end of the external tank 72. The distal end of the ink tube 62 is this received in the bottom of the external tank 72. An air port 133*a* is defined in the lid 133 in such a manner that the atmospheric pressure acts on the surface of the ink Ik.

In the illustrated embodiment, the attachment 19, the external tank 72, and the corresponding ink tube 62 define a liquid supply apparatus 73 serving as an ink supply apparatus that supplies the ink (the liquid) to the printer 10.

Operation of the attachment 19 and the liquid supply apparatus 73 of the printer 10 will hereafter be described.

If the cartridge 18 is held in the cartridge holder 17 when the work load of the printer 10 is to be increased, the cartridge 18 is removed from the cartridge holder 17 and replaced by the attachment 19, which is inserted in the cartridge holder 17. In such insertion, the slider 23 of the socket 22 is pressed by the attachment 19 to move from the position (a standby position) illustrated in the left and near socket 22 (22*a*) of FIG. 3 to the position (an insert position) illustrated in the right and far socket 22 (22*b*) of the drawing. At the insert position, the attachment 19 is arranged (accommodated) in the socket 22 in such a manner that the second liquid outlet port 54 or the like defined in the front surface 49*a* of the attachment body 49 are positioned with respect to the through hole 25 or the like defined in the slider 23 of the socket 22.

Specifically, the positioning projections 24*a*, 24*b* of the slider 23 are positioned with respect to and fitted in the positioning recesses 55*a*, 55*b* of the attachment body 49. The engagement lever 38 of the socket 22 is engaged with the engagement portion 56 of the attachment body 49, thus engaging and holding the attachment 19 in an immovable state. The terminal portion 27 of the slider 23 is connected to the circuit substrate 57 of the attachment body 49, allowing communication between the attachment 19 and a controller (not shown) of the printer 10 for transmitting and receiving information regarding the ink consumption or the like. The blocking portion 58 of the attachment body 49 is positioned with respect to the air outlet port 26 of the slider 23 and thus blocks the air outlet port 26.

Further, the front end of the ink supply needle 34 of the socket 22 is positioned with respect to and inserted in the second liquid outlet port 54 of the attachment body 49 (and the distal end 60*b* of the ink outlet member 60). The stopper 67 blocking the link passage 61 is thus further inserted into the link passage 61 against the urging force of the coil spring 66. This opens the link passage 61, allowing the ink to quickly flow into the inlet port 34*a* of the ink supply needle 34 through the link passage 61 after having been sent from the external tank 72 to the ink outlet member 60 of the attachment 19 through the corresponding ink tube 62 due to the liquid head difference. The ink then flows in the ink passage including the ink supply needle 34, the connection pipe 35, the connection passage 36, and the tube ribbon 21 and is thus supplied to the valve unit 16 of the recording head 15.

The first embodiment has the following advantages.

(1) When the attachment 19 is inserted in the socket 22 of the cartridge holder 17, the second liquid outlet port 54 (the ink outlet member 60) of the attachment body 49 is positioned with respect to the through hole 25 (the ink supply needle 34) of the socket 22. This permits supply of the ink to the printer 10. In other words, by simply inserting (mounting) the attachment body 49 in the socket 22, the ink supply from the external tank 72 to the recording head 15 of the printer 10 is permitted. The attachment 19 is thus easily and quickly installed in the printer 10. Accordingly, the attachment 19 is extremely easy to use.

(2) The ink outlet member 60 in which the link passage 61 is defined is detachable and attachable with respect to the attachment body 49. Thus, if clogging occurs in the link passage 61 or an operational problem happens in the stopper 67, the ink outlet member 60 can be removed from the attachment body 49 for performing maintenance work. This makes it further easy to use the attachment 19 in the printer 10.

(3) The cartridge holder 17 in which the attachments 19 are installed is immovably fixed to the body casing 11, instead of the carriage 14, which reciprocates when printing. Each of the ink tube 62 extending from the external tank 72 is thus prevented from being pulled by the carriage 14 when the carriage 14 is reciprocated. This ensures smooth supply of the ink from the external tank 72 to the attachment 19 through the corresponding ink tube 62.

(4) The installation state of the ink tubes 62 may become unstable due to the flexibility of the material forming the ink tubes 62. However, each cutout portion 59 of the attachment body 49 effectively supports the portion of the corresponding ink tube 62 upstream from the distal (downstream) end 62*a* of the ink tube 62, which is connected to the ink outlet member 60. This stabilizes the installation state of the ink tubes 62, making it further easy to use the attachments 19.

(5) In the liquid supply apparatus 73, the external tank 72 is mounted on the upper mounting portion 69*c* of the rack 69 and the printer 10 in which the attachment 19 is installed is mounted on the intermediate mounting portion 69*b* of the rack 69. This forcibly supplies the ink from the external tank 72 to the attachment 19 through the corresponding ink tube 62 due to the liquid head difference between the external tank 72 and the attachment 19. This ensures a sufficient ink supply to the recording head 15 of the printer 10.

(6) The printer 10 is mounted on the intermediate mounting portion 69*b* of the rack 69. The waste liquid tank 70 is mounted on the lower mounting portion 69*a*, which is located below the intermediate mounting portion 69*b*. The waste liquid tank 70 is connected to the printer 10 through the waste liquid tube 71. Thus, the waste ink (the waste liquid) drained from the printer 10 is effectively sent to the waste liquid tank 70 using the liquid head difference between the printer 10 and the waste liquid tank 70.

(7) There may be cases in which the printer 10 includes a detection mechanism. The detection mechanism detects a pressurization error (for example, air leakage) when the amount of the pressurized air supplied by the pressurization pump 20 exceeds a predetermined level. When the cartridge 18 is replaced by the attachment 19, the pressurization error may be detected erroneously. However, in the illustrated embodiment, when the attachment 19 is inserted (accommodated) in the socket 22 of the cartridge holder 17, the blocking portion 58 of the front surface 49*a* of the attachment body 49 blocks the air outlet port 26 defined in the slider 23 of the socket 22. This structure prevents the aforementioned erroneous error detection.

A second embodiment of the present invention will hereafter be described with reference to FIGS. 7A and 7B.

Unlike the attachment 19 of the first embodiment, an attachment 74 of the second embodiment includes a second air inlet port 75 and an air inlet chamber 76 instead of the blocking portion 58 of the attachment 19. The remainder of the attachment 74 is identical to the corresponding parts of the attachment 19. Therefore, same or like reference numerals are given to parts (components) of the second embodiment that are the same as or like corresponding parts of the first embodiment and detailed description thereof will be omitted. The following description thus focuses on the difference between the first embodiment and the second embodiment.

Figure 7A:
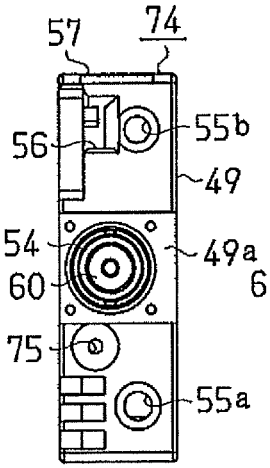
FIG. 7A is a plan view showing an attachment according to a second embodiment of the present invention in a state separated from a lid member.
Figure 7B:
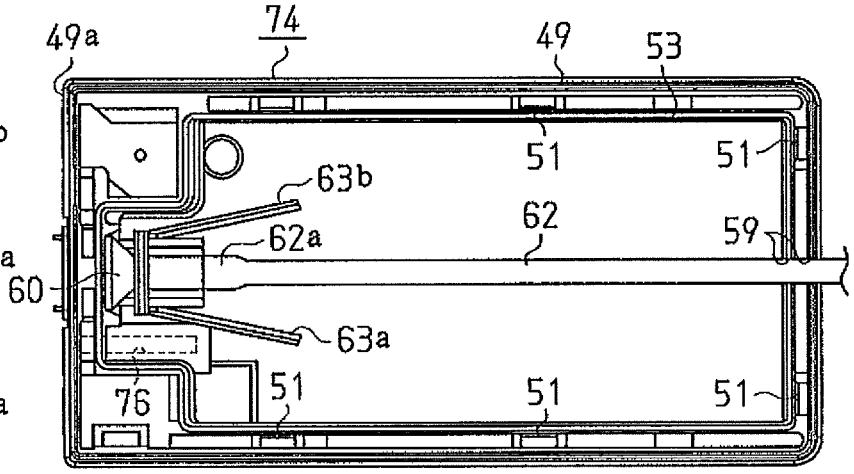
FIG. 7B is a front view showing the attachment of FIG. 7A.

As shown in FIGS. 7A and 7B, in the second embodiment, a second air inlet port 75 is defined in the front surface 49*a* of the attachment body 49 of the attachment 74. An air inlet chamber 76 is defined in the attachment body 49 at a position corresponding to the second air inlet port 75. The volume of the air inlet chamber 76 is smaller than the volume of the accommodation chamber 41, which serves as the air inlet chamber defined in the casing 39 of the cartridge 18.

Thus, in the second embodiment, when the attachment 74 is inserted (accommodated) in the socket 22 of the cartridge holder 17, the second air inlet port 75 defined in the front surface 49*a* of the attachment body 49 is positioned with respect to and connected to the air outlet port 26 defined in the slider 23 of the socket 22. This allows the pressurized air supplied by the pressurization pump 20 to flow from the air outlet port 26 into the air inlet chamber 76.through the second air inlet port 75.

Accordingly, in addition to the advantages (1) to (6) of the first embodiment, the second embodiment has the following advantages.

(8) The printer 10 may have a detection mechanism, which detects a pressurization error (for example, air leakage) when the amount of the pressurized air supplied by the pressurization pump 20 exceeds a predetermined level (for example, a level corresponding to the volume of the accommodation chamber 41 of the cartridge 18). When the cartridge 18 is replaced by the attachment 19, the pressurization error may be detected erroneously. However, in the second embodiment, with the attachment 74 inserted (accommodated) in the socket 22 of the cartridge holder 17, the acceptable amount of the pressurized air flowing from the air outlet port 26 of the slider 23 into the air inlet chamber 76 through the second air inlet port 75 of the attachment body 49 is set to an extremely small value. This prevents the aforementioned erroneous error detection, substantially in the same manner as has been described in the advantage (7) of the first embodiment.

(9) There may be cases in which the printer 10 includes a control system that detects a pressurization error (for example, insufficient pressurization caused by blockage of an air path) if the amount of the pressurized air supplied by the pressurization pump 20 is smaller than a predetermined level (for example, the level corresponding to the volume of the air inlet chamber 76 of the attachment 74). The second embodiment is particularly advantageous in that such detection error is effectively detected.

A third embodiment of the present invention will now be described with reference to FIG. 8.

Figure 8:
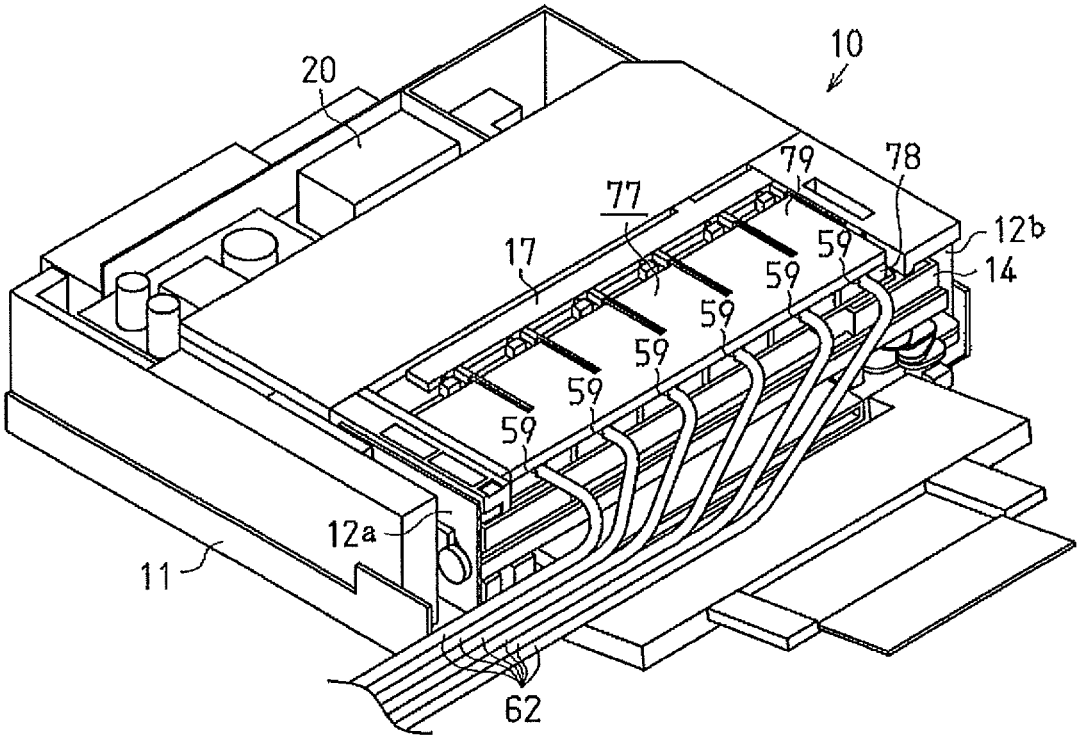
FIG. 8 is a perspective view showing a printer in which an attachment according to a third embodiment of the present invention is installed.

As shown in FIG. 8, in the third embodiment, an attachment 77 is a large-sized type formed by integrating a number of (in the third embodiment, six) the attachments 19 of the first embodiment corresponding to the quantity of the sockets 22 of the cartridge holder 17. In the attachment 77, the attachments 19 are aligned in parallel and formed as an integral body. The attachment 77 includes an attachment body 78 and a lid member 79. The attachment body 78 has a shape defined collectively by six attachment bodies 49 of the attachment 19 of the first embodiment, which are aligned in parallel. The lid member 79 has a shape collectively defined by six lid members 50 of the attachment 19 of the first embodiment, which are aligned in parallel.

Although not illustrated, six ink outlet members 60, each of which is identical to the ink outlet member 60 of the first embodiment, are removably installed and equally spaced in the attachment body 78. When the attachment 77 is received in the cartridge holder 17, each of the ink outlet members 60 is positioned with respect to the corresponding one of the ink supply needles 34, which are each provided in the corresponding one of the six sockets 22. In the attachment 77, each ink tube 62, which has the distal end 62*a* connected to the proximal end 60*a* of the corresponding ink outlet member 60, is introduced out to the exterior through the cutout portions 59 of the attachment body 78. Each ink tube 62 is thus connected to the external tank 72 (see FIG. 6).

Accordingly, the third embodiment has the following advantage in addition to the advantages (1) to (6) of the first embodiment.

To replace the multiple (six) cartridges 18 by the attachment 77 in the cartridge holder 17, removal of the cartridges 18 must be repeated for six times. Contrastingly, through a single replacement of the attachment 77, the ink outlet members 60 are simultaneously connected to the ink supply needles 34 of the corresponding sockets 22. In other words, the attachment 77 is defined as a simply attachable multicolor attachment 77 corresponding to the cartridges 18 of the six color inks. The attachment 77 is thus further quickly installed.

A fourth embodiment of the present invention will now be described with reference to FIGS. 9 to 11.

Figure 9:
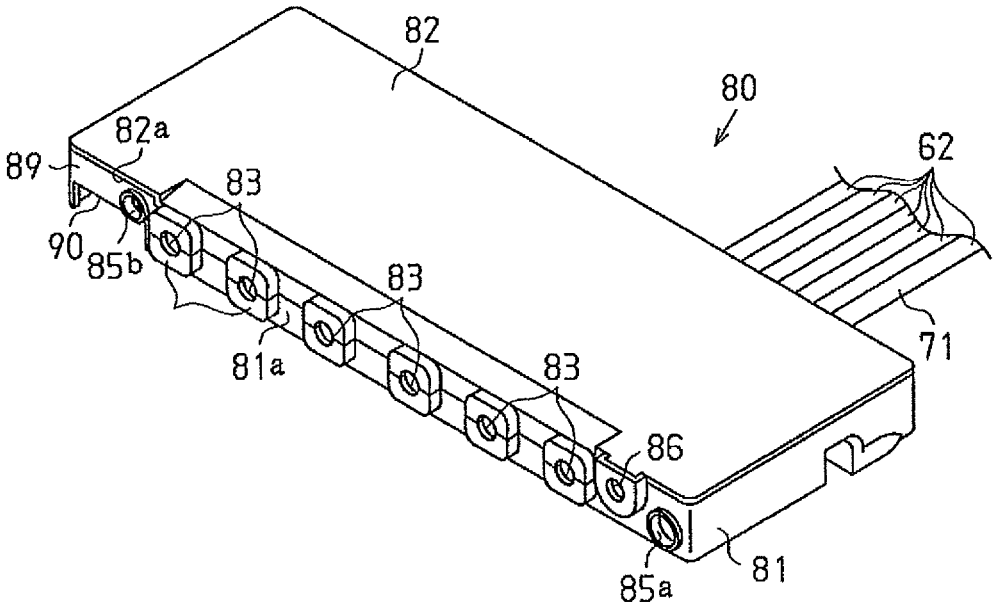
FIG. 9 is a perspective view showing an attachment according to a fourth embodiment of the present invention.
Figure 10:
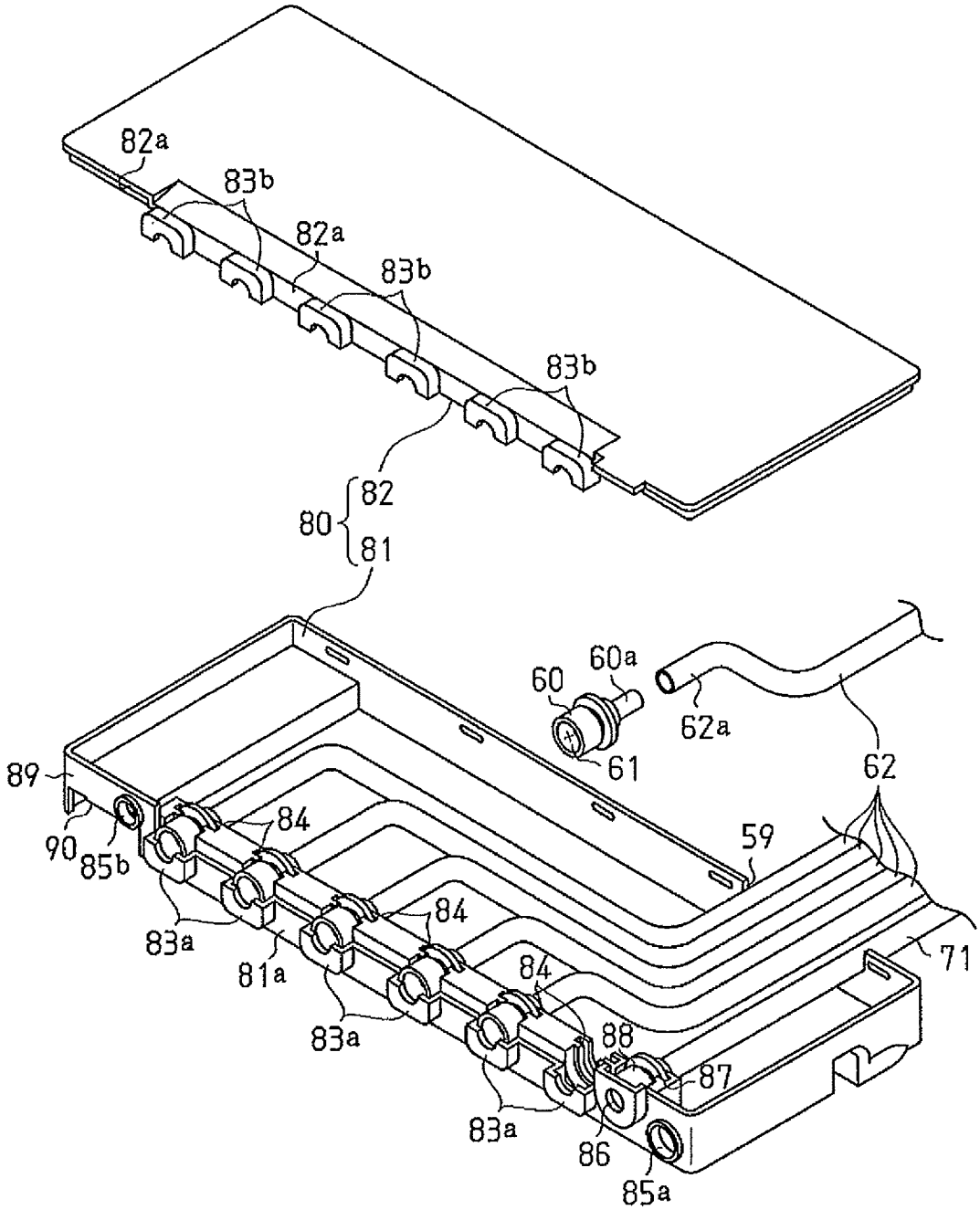
FIG. 10 is an exploded perspective view showing the attachment of FIG. 9.

As shown in FIGS. 9 and 10, in the fourth embodiment, an attachment 80 has an attachment body 81 and a lid member 82. The attachment body 81 is shaped like a laterally elongated box with a bottom. The lid member 82 covers an upper opening of the attachment body 81. Referring to FIG. 10, a plurality of (in the fourth embodiment, six) lower support portions 83*a* are formed on a front surface 81*a* of the attachment body 81 and equally spaced in a lateral direction of the attachment body 81. In correspondence with the lower support portions 83*a* of the attachment body 81, a plurality of (in the fourth embodiment, six) upper support portions 83*b* are formed on a front end 82*a* of the lid member 82. Each of the lower support portions 83*a* and the corresponding one of the upper support portions 83*b* have opposing semicircular ends. The lower support portions 83*a* and the corresponding upper support portions 83*b* are mutually engaged when the attachment body 81 is covered by the lid member 82. This defines a plurality of (in the fourth embodiment, six) support ports 83 that are aligned in parallel and spaced equally in the lateral direction of the attachment body 81 (see FIG. 9).

A support portion 84 defined by a flanged groove is defined behind each of the lower support portions 83*a* of the attachment body 81. An ink outlet member (a link portion) 60 like the one for the attachment 19 of the first embodiment is separably supported by each support portion 84. The distal end (the downstream end) 62*a* of the corresponding ink tube 62, or the liquid supply passage extending from the external tank 72 (see FIG. 6), is connected to the proximal end 60*a* of the corresponding ink outlet member 60, or the upstream end of the link passage 61 of the ink outlet member 60.

A pair of positioning recesses 85*a*, 85*b* are defined in opposing lateral ends of the front surface 81*a* of the attachment body 81. A waste ink inlet port (a second waste liquid inlet portion) 86 is provided at the left side of the positioning recess 85*a* of one end (in FIG. 9, the right end) of the front surface 81*a* of the attachment body 81. The waste ink (the waste liquid) is introduced into the attachment body 81 through the waste ink inlet port 86. A flanged support groove 87 is defined behind the waste ink inlet port 86. A waste ink inlet member 88 identical to the ink outlet member 60 is separably supported by the support groove 87. The waste liquid tube 71, which extends from the waste liquid tank 70 (see FIG. 6) is connected to the waste ink inlet member 88.

A flat, second contact portion 89 is defined at the left side of the positioning recess 85*b* of the opposing end (the left end of FIG. 9) of the front surface 81*a* of the attachment body 81. A circuit substrate receiving recess 90 is defined in the front surface 81*a* of the attachment body 81 and below the second contact portion 89. A non-illustrated circuit substrate is received in the circuit substrate receiving recess 90. Like the attachment 77 of the third embodiment, the attachment 80 of the fourth embodiment is a multi-color attachment 80. The attachment 80 is mounted on the cartridge holder 17 as a replacement of a multi-color cartridge (not shown) that incorporates six color-ink packs and has the same configuration as the attachment 80. The cartridge includes a first waste liquid inlet portion (a waste ink inlet port) defined in a front surface of the cartridge. The cartridge thus functions as a waste liquid collector. A first contact portion (not shown) is also defined in the front surface of the cartridge. The first contact portion contacts and presses the valve opening lever 99, which will be described later.

The cartridge holder 17 will now be described with reference to FIGS. 11 and 12. The attachment 80 is received in the cartridge holder 17 as a replacement of the multi-color cartridge functioning as a waste liquid collector.

Figure 11:
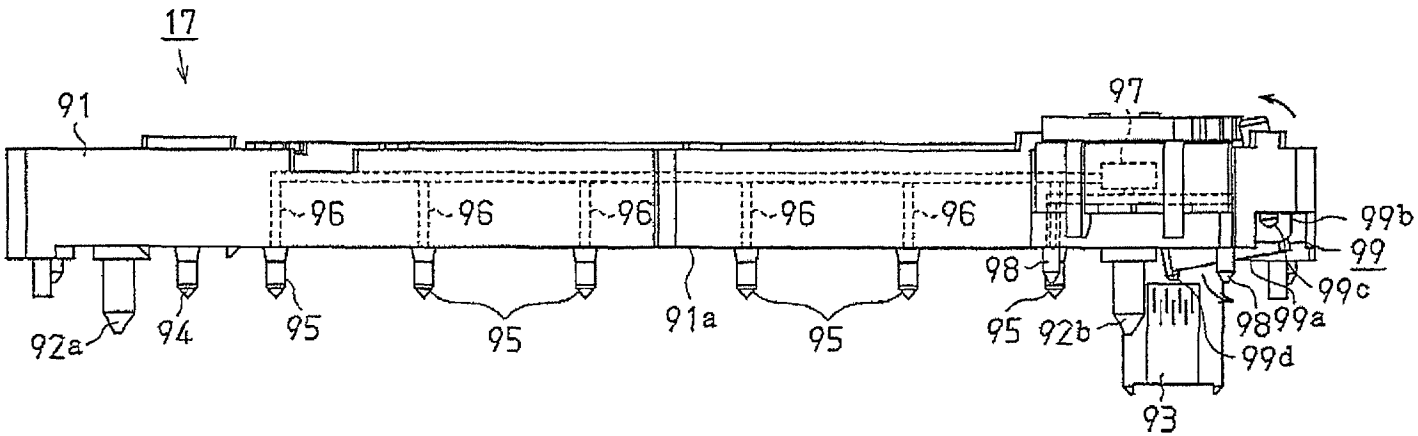
FIG. 11 is a plan view showing a connection portion of a cartridge holder on which the attachment of FIG. 9 is mounted.
Figure 12:
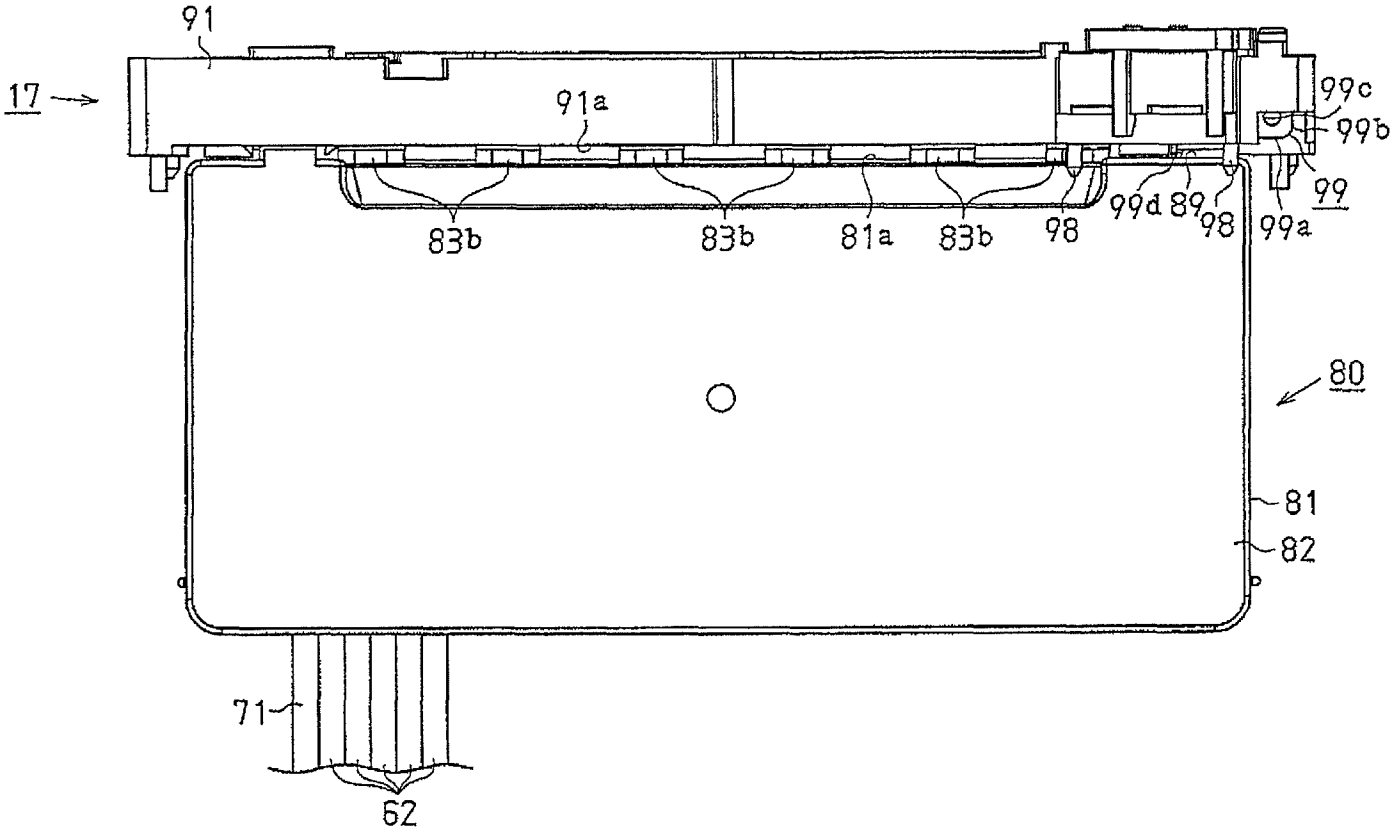
FIG. 12 is a plan view showing the attachment of FIG. 9 mounted on the mounting portion of FIG. 11.

As shown in FIG. 11, in the fourth embodiment, the cartridge holder 17 includes a substantially parallelepiped connection portion 91, which is laterally elongated like the attachment 80 (or the cartridge). The connection portion 91 has a front surface 91*a* that faces the front surface 81*a* of the attachment body 81 when the attachment 80 is received in the cartridge holder 17. A pair of positioning projections 92*a*, 92*b* are projected from the front surface 91*a* of the connection portion 91 at positions corresponding to the positioning recesses 85*a*, 85*b* of the attachment 80. A terminal portion 93 is projected from the front surface 91*a* at a position corresponding to the circuit substrate receiving recess 90 of the attachment 80.

Thus, when the attachment 80 is mounted on the connection portion 91, each of the positioning projections 92*a*, 92*b* is fitted in the corresponding one of the positioning recesses 85*a*, 85*b*. This restricts movement of the attachment 80 in a direction crossing the insert direction of the attachment 80 (in FIG. 11, a horizontal direction). In this state, the terminal portion 93 contacts the circuit substrate received in the circuit substrate receiving recess 90, thus permitting communication between the attachment 80 and the controller (not shown) of the printer 10 for transmitting and receiving information regarding the ink consumption or the like. Although not illustrated, an engagement portion is provided in the attachment 80 and an engagement lever is formed in the connection portion 91. Through engagement between the engagement portion and the engagement lever, the attachment 80 is immovably mounted on the connection portion 91 of the cartridge holder 17.

A waste ink outlet needle (a waste liquid outlet portion) 94 is projected from the front surface 91*a* of the connection portion 91 at a position corresponding to the waste ink inlet port 86 of the attachment 80. Ink supply needles (liquid inlet portions) 95 are projected from the front surface 91*a* at positions corresponding to the support ports 83. A non-illustrated inlet bore is defined in the distal end of each of the ink supply needles 95. Ink passages (liquid passages) 96 are defined in the connection portion 91 in correspondence with the ink supply needles 95. The proximal end of each ink supply needle 95 is connected to the corresponding ink passage 96.

Thus, when the attachment 80 is mounted on the connection portion 91, the waste ink outlet needle 94 is fitted in the waste ink inlet port 86. The waste ink drained from the printer 10 is sent from the waste ink inlet member 88 to the waste liquid tank 70 (see FIG. 6) through the waste liquid tube 71. Meanwhile, the ink supplied from the external tank 72 through the corresponding ink tube 62 flows in the link passages 61 of the ink outlet members 60 and is introduced into each of the ink passages 96 of the connection portion 91 through the corresponding ink supply needles 95.

A passage valve 97 is provided in the connection portion 91. A communicating portion 98 is projected from the front surface 91*a* of the connection portion 91. After having been introduced into each ink passage 96, the ink passes through the passage valve 97 and is supplied to the recording head 15 of the printer 10 through the communicating portion 98. In order to stop a backflow of the ink, when the attachment 80 (or the cartridge) is not received in the connection portion 91, the passage valve 97 is held in a closed state for maintaining the ink passages 96 in a closed state. Thus, referring to FIG. 11, a valve opening lever (a movable member) 99 is provided in the connection portion 91 at a position corresponding to the second contact portion 89 of the attachment 80. When the attachment 80 is provided in the connection portion 91, the valve opening lever 99 operates to open the ink passages 96.

The valve opening lever 99 includes an operating piece 99*a*, an operated piece 99*b*, and a pivotal shaft 99*c*. With the operating piece 99*a* and the operated piece 99*b* fixedly connected together, the pivotal shaft 99*c* functions as the pivotal center of the operating piece 99*a* and the operated piece 99*b*. The operating piece 99*a* is shaped like a plate and a projection 99*d* projects from a corner of a front end of the operating piece 99*a*. The operating piece 99*a* is (the operating piece 99*a* and the operated piece 99*b* are) urged by the force generated by a non-illustrated urging spring normally in the direction indicated by the arrow of FIG. 11 (a counterclockwise direction). The front end of the operating piece 99*a* is thus maintained in a state slightly inclined with respect to the insert direction of the attachment 80.

In this state, by installing the attachment 80 in the connection portion 91 of the cartridge holder 17, the second contact portion 89 of the attachment 80 is brought into contact with the projection 99*d* of the operating piece 99*a* of the valve opening lever 99. This pivots the operating piece 99*a* about the pivotal shaft 99*c* in a clockwise direction. The operated piece 99*b* is thus caused to pivot in the clockwise direction, switching the passage valve 97 from the closed state to the open state. This connects the recording head 15 of the printer 10 to the ink supply needles 95 through the corresponding ink passages 96, thus permitting the ink supply.

Accordingly, in addition to the substantially equivalent advantages as the advantages (1) to (6) of the first embodiment, the fourth embodiment has the following advantages.

(11) When installing the attachment 80 in the connection portion 91 of the cartridge holder 17, the second contact portion 89 of the attachment 80 presses the valve opening lever 99 of the connection portion 91 to switch to the open state. This effectively permits communication between the ink supply needles 95 and the recording head 15 through the ink passages 96. Accordingly, modification of the printer 10 is unnecessary when installing the attachment 80 in the cartridge holder 17 having the passage valve 97 as a replacement of a cartridge. Also, the attachment 80 suppresses an ink back flow. That is, the attachment 80 is generally applicable to different printers.

(12) The attachment 80 includes the waste ink inlet port 86 and the waste ink inlet member 88. Accordingly, if the attachment 80 is installed as a replacement of a cartridge functioning as a waste liquid collector, the waste ink is effectively sent to the waste liquid tank 70 through the waste liquid tube 71 after having passed through the waste ink inlet port 86 and the waste ink inlet member 88.

The illustrated embodiments may be modified in the following forms.

Figure 13:
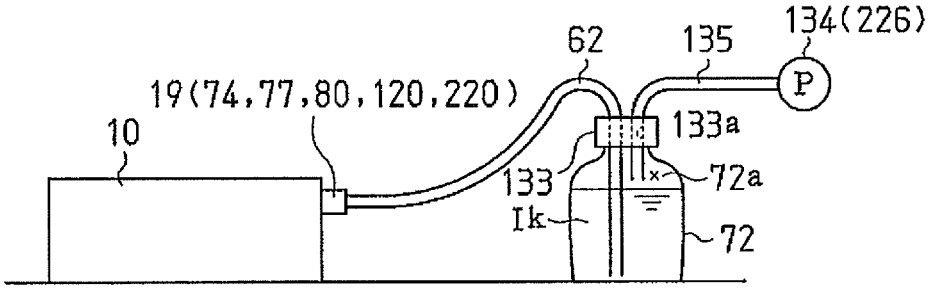
FIG. 13 is a side view showing arrangement of a liquid supply apparatus of a modified embodiment.

As shown in FIG. 13, an area above the link level in the retainer chamber 72*a* of the external tank 72 may be defined as an air inlet chamber. An air supply tube 135, or a pressurized air supply tube, supplies pressurized air into the air inlet chamber through actuation of an air pump 134 serving as a pressurization pump. Specifically, the air pump 134 is connected to the air port 133*a* of the lid 133, which covers the upper end of the external tank 72, through the air supply tube 135. The level surface of the ink Ik in the external tank 72 thus receives air pressure generated by the air pump 134, instead of atmospheric pressure.

This arrangement forcibly supplies the ink from the external tank 72 to the attachment 19 (or 74 or the attachment 77 or 80) through the corresponding ink tube 62 by the pressurization force generated by the pressurized air. Insufficient ink supply to the recording head 15 of the printer 10 is thus suppressed.

It is thus unnecessary to ensure a difference between the height of the external tank 72 and the height of the attachment 19. Also, by controlling operation of the air pump 134, supply of the ink supply pressure can be easily suspended or adjusted.

Figure 14:
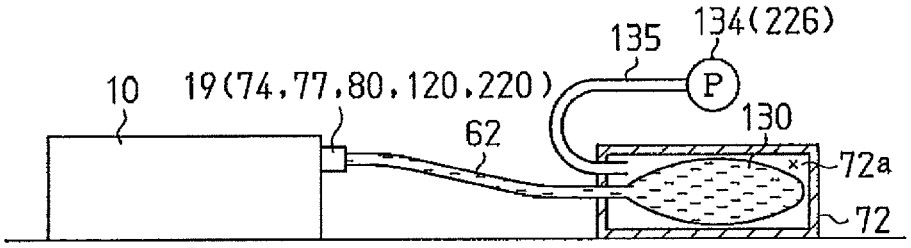
FIG. 14 is a side view showing arrangement of a liquid supply apparatus of another modified embodiment.

FIG. 14 is another modified embodiment performing the forcible ink supply. As shown in the drawing, a large-capacity ink pack 130 is received in the retainer chamber (the air inlet chamber) 72*a* of the external tank 72. The pressurized air is introduced from the air pump 134, the pressurization pump, into the retainer chamber 72*a* through the air supply tube 135. That is, the air pressure produced by the air pump 134 is introduced into the external tank 72, which is a sealed casing formed of hard material. This squeezes the ink Ik out of the ink pack 130 and sends the ink Ik to the attachment 19.

In this case, the air pressure that squeezes the ink Ik out from the ink pack 130 ensures generation of supply pressure of the ink Ik, which is supplied to the attachment 19. It is thus unnecessary to provide a difference between the height of the external tank 72 and the height of the attachment 19. Further, by controlling operation of the air pump 134, supply of the ink supply pressure can be easily suspended or adjusted.

Figure 15:
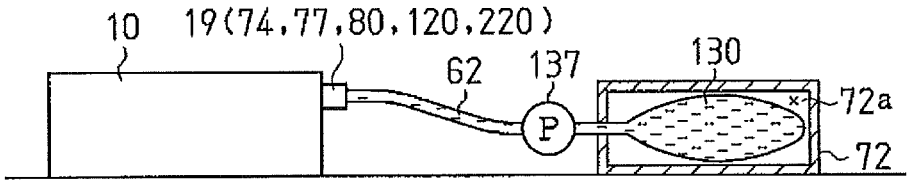
FIG. 15 is a side view showing arrangement of a liquid supply apparatus of another modified embodiment.

Alternatively, as shown in FIG. 15, a liquid pump 137, or a suction pump, may be arranged in each ink tube 62, which connects the large-capacity ink pack 130 received in the retainer chamber 72*a* of the external tank 72 to the attachment 19 (74, 77, 80). Specifically, the external tank 72 is defined as an open casing. The ink Ik is sent from the ink pack 130 in the external tank 72 to the attachment 19 through pressurization by the liquid pump 137. This ensures generation of the supply pressure of the ink Ik.

In this case, through actuation of the liquid pump 137, the ink is drawn from the ink pack 130, which is located upstream from the liquid pump 137. The ink is then forcibly supplied to the attachment 19 (74, 77, 80), which is located downstream from the liquid pump 137. Accordingly, by controlling operation of the liquid pump 137, supply of the ink supply pressure is easily suspended or adjusted.

A waste ink inlet port (a waste liquid inlet port) may be defined in the attachment body 49 (the attachment body 78) of the attachment 19 (the attachment 74, 77). A waste ink inlet member is secured to the attachment body 49 (the attachment body 78). A waste liquid tube (a waste liquid passage) is connected to the ink inlet member, thus sending the waste ink to the waste liquid tank.

In the fourth embodiment, the valve opening lever 99 is employed as the movable member that selectively opens and closes the ink passages (the liquid passages) 96 by being pressed by or released from the second contact portion 89 of the attachment 80. However, the movable member may be defined by any suitable component other than the valve opening lever 99, such as a component that selectively opens and closes the passage valve 97 through linear movement caused by pressing by the second contact portion 89.

In the second embodiment, the volume of the air inlet chamber 76 in the attachment body 49 may be altered as needed, as long as such volume is smaller than the volume of the accommodation chamber 41 of each cartridge 18.

As tube support portions of any of the attachment bodies 49, 78, 81, tube support ribs or tube support grooves may be provided in addition to the cutout portions 59.

The cartridge holder 17 may be arranged in the carriage 14 of the printer 10.

As long as the ink outlet member 60, which serves as the link portion and the liquid outlet member, has a cylindrical shape in which the link passage 61 is defined, the ink outlet member 60 may be defined by, for example, a simple pipe body.

The link portion may be formed integrally with the attachment body 49, 78, 81.

A liquid container and a liquid supply apparatus according to a fifth embodiment of the present invention will hereafter be described with reference to the attached drawings.

Figure 16:
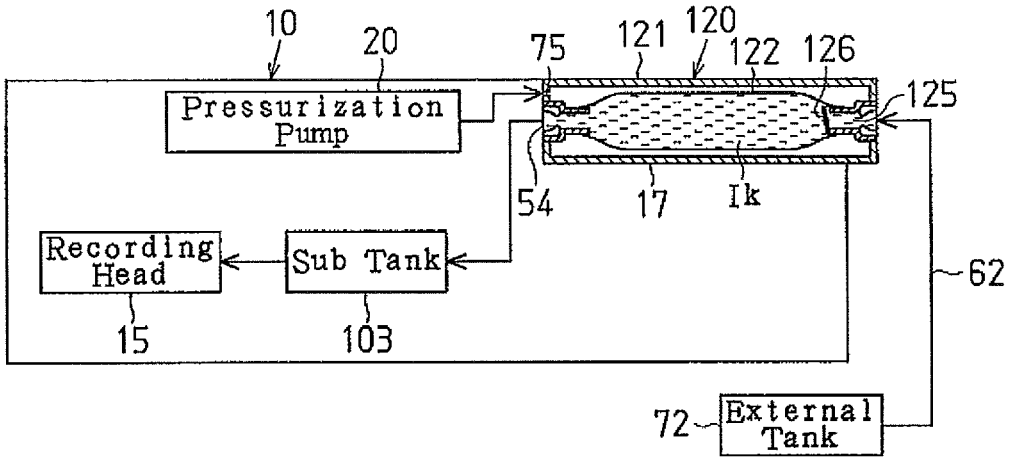
FIG. 16 is a block diagram schematically representing an inkjet recording apparatus in which a liquid container according to a fifth embodiment of the present invention is installed as a replacement of a liquid cartridge.

As shown in FIG. 16, the printer 10 serving as an inkjet recording apparatus includes a recording head 15, or a liquid ejecting portion, a sub tank 103, a pressurization pump 20, or an air pressurizing portion, and a cartridge holder 17. The cartridge holder 17 holds a plurality of attachments 120, or liquid containers according to the fifth embodiment.

Figure 17:
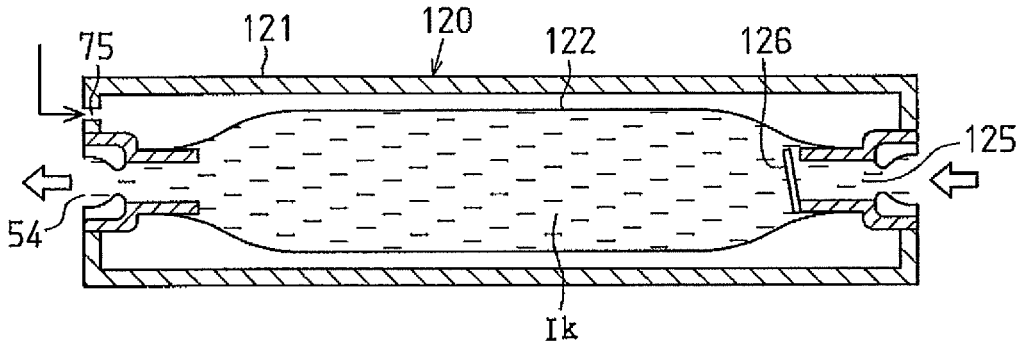
FIG. 17 is a longitudinal cross-sectional view showing the liquid container of FIG. 16.
Figure 25:
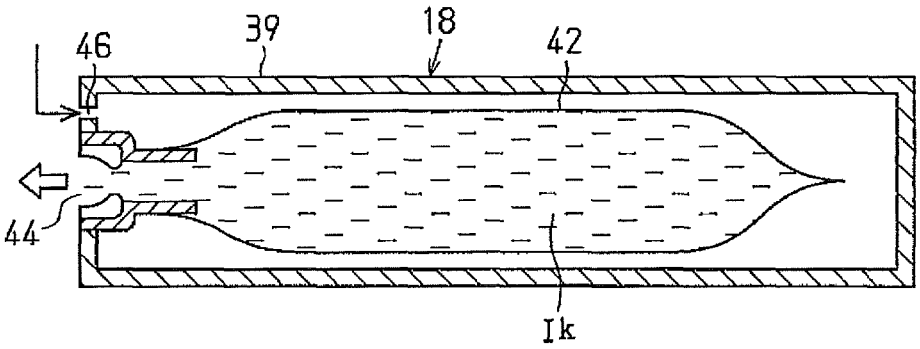
Fig. 25 (Prior Art)
FIG. 25 is a longitudinal cross-sectional view showing a cartridge of FIG. 24.

Each of the attachments 120 has an outline identical to that of the typical cartridge 18 of FIG. 25. As illustrated in FIG. 17, each attachment 120 is formed by accommodating an ink pack 122 formed of flexible material in a sealed casing 121, which is formed of hard resin. A second air inlet port 75 and a second liquid outlet port 54 are defined in one end of the sealed casing 121. Externally produced pressurized air is introduced into the sealed casing 121 through the second air inlet port 75. The pressurized air thus produces pressure that acts to send the ink (the liquid) Ik from the ink pack 122 to the exterior through the second liquid outlet port 54.

When the attachments 120 are received in the cartridge holder 17 of the printer 10, the second liquid outlet port 54 and the second air inlet port 75 are connected to the sub tank 103 and the pressurization pump 20.

Unlike the cartridges 18, a liquid supply port 125 is defined in the other end of the sealed casing 121 of each attachment 120. The ink Ik is supplied from the exterior to the attachment 120 through the liquid supply port 125. A check valve 126 is provided in the liquid supply port 125. The check valve 126 opens when the external pressure is greater than the internal pressure. The check valve 126 closes when the internal pressure greater than the external pressure.

As illustrated in FIG. 16, the external tank 72 is connected to the liquid supply port 125 of each attachment 120 through the corresponding ink tube 62. Thus, the attachment 120, the ink tube 62, and the external tank 72 define the liquid supply apparatus 73.

The supply pressure of the ink (liquid supply) Ik, which acts to send the ink Ik from the external tank 72 to each attachment 120 through the liquid supply port 125, is greater than the atmospheric pressure but smaller than the air pressure produced by the pressurization pump 20 (the outlet pressure of the ink Ik generated by the pressurized air, which acts to move the ink Ik out from the attachment 120 through the second liquid outlet port 54).

Operation of each attachment 120 and that of the liquid supply apparatus 73 will now be explained.

In the fifth embodiment, each attachment 120 includes the check valve 126 provided in the liquid supply port 125 of the attachment 120. The supply pressure of the ink Ik, which acts to send the ink Ik from the external tank 72 to the attachment 120 through the liquid supply port 125, is smaller than the outlet pressure of the ink Ik produced by the pressurized air, which acts to move the ink Ik out from the attachment 120 through the second liquid outlet port 54. The check valve 126 thus closes if the pressurized air generated by the pressurization pump 20 flows into the attachment 120, even when the ink Ik is being supplied from the external tank 72 to the attachment 120.

When supply of the pressurized air by the pressurization pump 20 is suspended, the supply pressure of the ink Ik flowing from the external tank 72 (the pressure in the exterior of the attachment 120) becomes greater than the pressure in the attachment 120. This opens the check valve 126, thus introducing the ink Ik into the attachment 120.

That is, the ink Ik can be supplied to each attachment 120 without influencing supply of the ink Ik into the recording head 15 by air pressure. Therefore, if the cartridge 18 is replaced by the attachment 120, the attachment 120 is perfectly compatible with the pressurization pump 20 used in the ink pressurization supply system of the printer 10. Normal operation of the printer 10 is thus ensured.

Further, since modification of the printer 10 is unnecessary when replacing each cartridge 18 by the attachment 120 according to the present invention, an optional supply system of the ink Ik from the large-capacity external tank 72 is easily employed. Also, since the supply pressure of the ink Ik to the attachment 120 is set to a value lower than the pressure produced by the pressurization pump 20 of the printer 10, the configuration of the liquid supply apparatus 73 is simplified.

Accordingly, the attachments 120 and the liquid supply apparatus 73 can be employed without modifying the printer 10, while ensuring compatibility between the attachments 120 and the liquid supply apparatus 73 and the pressurization pump 20 of the pressurization supply system of the ink Ik of the printer 10. The attachment 120 and the liquid supply apparatus 73 thus stabilize supply of the ink Ik.

Figure 18:
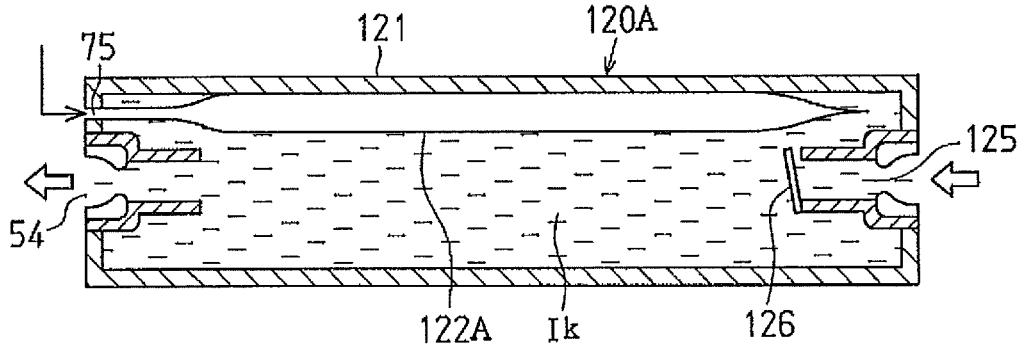
FIG. 18 is a longitudinal cross-sectional view showing a modified embodiment of the liquid container of FIG. 16.

Referring to FIG. 17, in each attachment 120 of the fifth embodiment, the ink Ik is retained in the ink pack 122, which is received in the sealed casing 121. The pressurized air is introduced into the space defined outside the ink pack 122 in the sealed casing 121, thus sending the ink Ik out from the ink pack 122. However, as in an attachment 120A of FIG. 18, the ink Ik may be retained directly in the sealed casing 121. An air pack 122A is received in the sealed casing 121 and the pressurized air is introduced into the air pack 122A. Also in this case, the ink Ik can be introduced out of the attachment 120A by the pressure corresponding to the pressure produced by the air from the pressurization pump 20.

Next, methods for applying the supply pressure of the ink Ik, which is supplied from the external tank 72 of the liquid supply apparatus 73 to each attachment 120 (120A) of the fifth embodiment, will be described. Specifically, the respective methods are illustrated in FIGS. 6 and 13 to 15.

In FIG. 6, the position head corresponding to the difference between the level of the ink Ik in the external tank 72 and the level of the ink Ik in the attachment 120 is applied to the liquid supply port 125 of the attachment 120 (120A) as the supply pressure of the ink Ik. Such supply pressure is thus easily adjusted by altering the height of the level of the ink Ik in the external tank 72.

In FIG. 13, the air pressure that presses the ink Ik in the external tank 72 ensures generation of the supply pressure of the ink Ik, which is supplied to the attachment 120 (120A).

In FIG. 14, the air pressure that presses the ink Ik in the ink pack 130 ensures generation of the supply pressure of the ink Ik, which is supplied to the attachment 120 (120A). Supply of the supply pressure is thus easily suspended or adjusted by controlling operation of the air pump 134.

In FIG. 15, if the ink Ik is supplied to the attachment 120 (120A) through pressurization by the liquid pump 137, supply of the supply pressure is easily suspended or adjusted by controlling operation of the liquid pump 137.

The configurations of the liquid container and the air inlet port, the liquid outlet port, the liquid supply port, the check valve, and the external tank of the liquid supply apparatus according to the present invention are not restricted to those of the illustrated embodiments. It is to be understood that these configurations may be modified in various forms in accordance with the intent of the present invention.

A liquid supply apparatus according to a sixth embodiment of the present invention will now be described with reference to the attached drawings.

Figure 19:
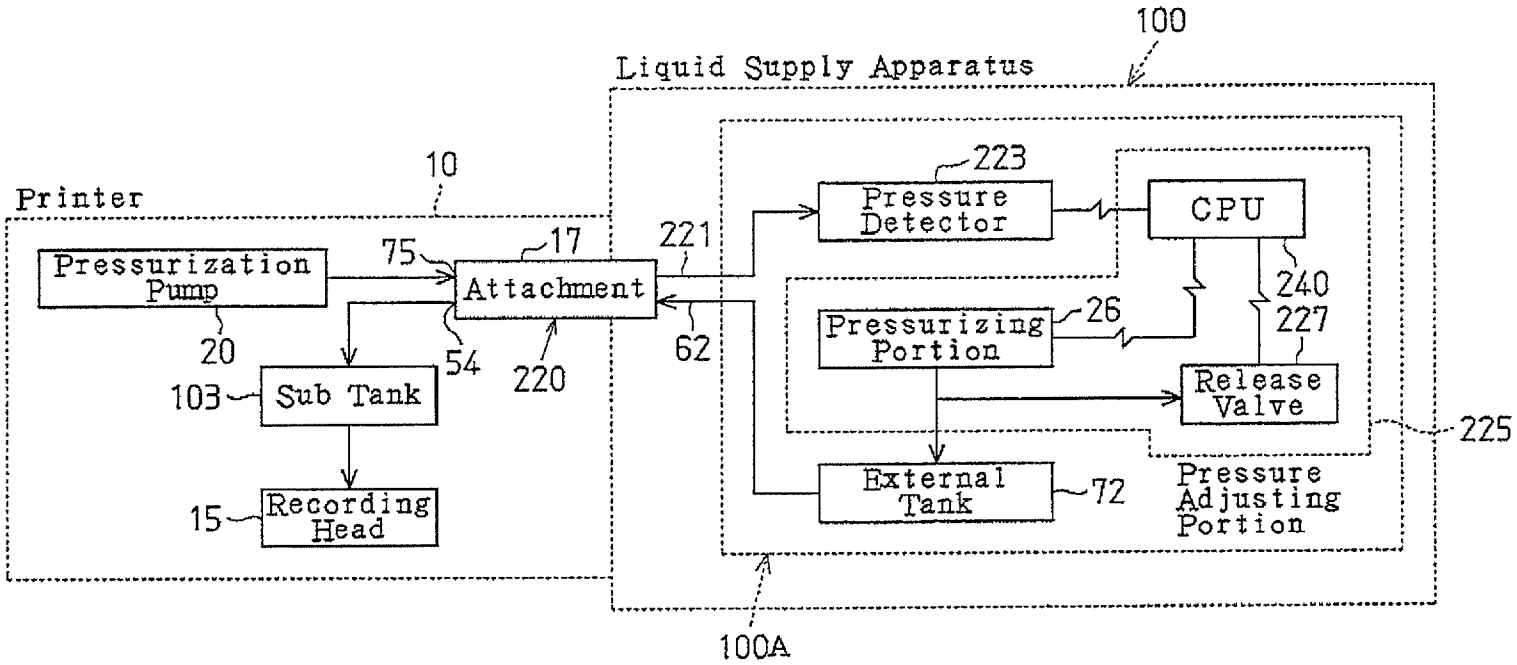
FIG. 19 is a block diagram schematically representing a liquid supply apparatus according to a sixth embodiment of the present invention.
Figure 20:
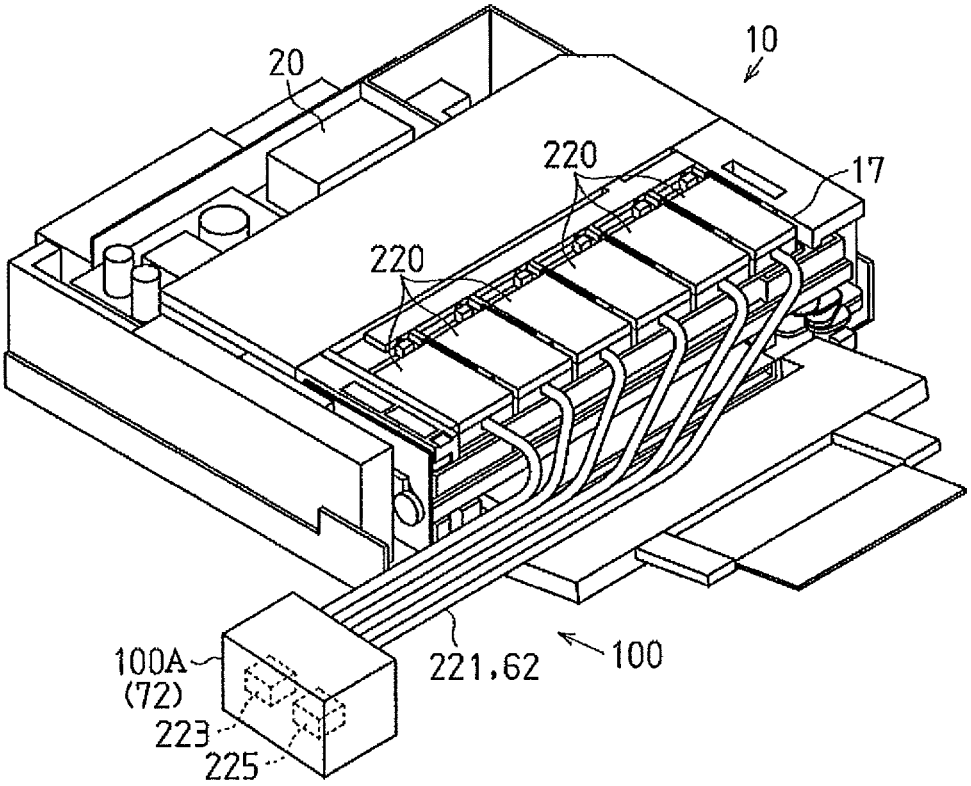
FIG. 20 is a perspective view showing the appearance of the liquid supply apparatus of FIG. 19.

As shown in FIG. 19, a liquid supply apparatus 100 according to an embodiment of the present invention is incorporated in the printer 10. The printer 10 includes the recording head 15, the sub tank 103, the pressurization pump 20, and the cartridge holder 17. Referring to FIG. 20, attachments 220 are received in the cartridge holder 17, instead of typical liquid cartridges.

Figure 21:
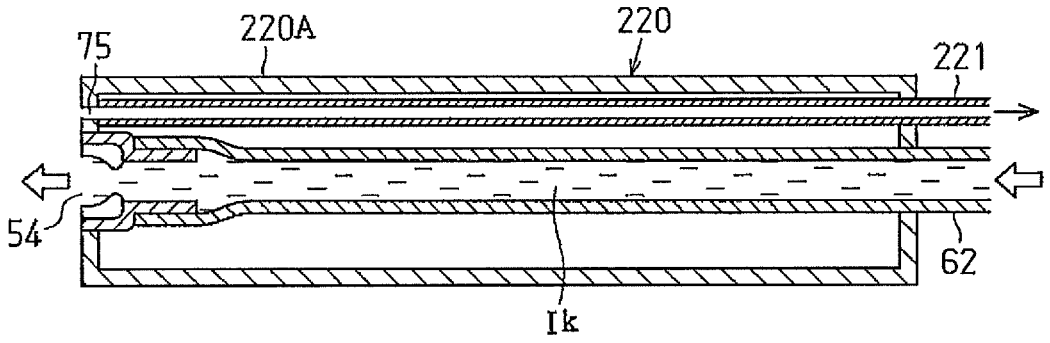
FIG. 21 is a longitudinal cross-sectional view showing an attachment of FIG. 20.

Each of the attachments 220 has an outline identical to the outline of the typical cartridge 18 of FIG. 25. With reference to FIG. 21, a second liquid outlet port 54 and a second air inlet port 75 are defined at an end of a hollow casing 220A of each attachment 220, which is formed of hard resin. The second liquid outlet port 54 serves as a first connection port through which the ink Ik is sent out of the hollow casing 220A. The second air inlet port 75 serves as a second connection port through which pressurized air is supplied from the exterior into the hollow casing 220A.

When the attachment 220 is mounted on the cartridge holder 17 of the printer 10, the second liquid outlet port 54 and the second air inlet port 75 of the attachment 220 are connected to the sub tank 103 and the pressurization pump 20 of the printer 10, respectively.

Referring to FIG. 21, a distal end of an air detection tube 221 is,connected to the second air inlet port 75 of each attachment 220 from inside the hollow casing 220A. A distal end of the corresponding ink tube 62, or a tubular passage, is connected to the second liquid outlet port 54 of the attachment 220 from inside the hollow casing 220A. The air detection tube 221 and the ink tube 62 are introduced out of the hollow casing 220A from an opposing end of the hollow casing 220A. The air detection tube 221 and the ink tube 62 are thus connected to a liquid supply apparatus body 100A of FIG. 20.

The liquid supply apparatus 100 is formed by the liquid supply apparatus body 100A, the air detection tubes 221, the ink tubes 62, and the attachments 220.

As illustrated in FIG. 19, the liquid supply apparatus body 100A includes the external tank 72, a pressure detector 223, and a pressure adjusting portion 225. The external tank 72 retains the ink Ik (the liquid to be supplied) and is connected to the second liquid outlet port 54 of each attachment 220 through the corresponding ink tube 62. The pressure detector 223 detects air pressure applied by the pressurization pump 20 of the printer 10 through the second air inlet port 75 of the attachment 220 and the air detection tube 221. The pressure adjusting portion 225 adjusts the supply pressure of the ink Ik, which is sent from the external tank 72 to the second liquid outlet port 54 of the attachment 220.

The pressure adjusting portion 225 includes a pressurizing portion 226, a release valve 227, and a CPU (a controller) 240. The pressurizing portion 226 pressurizes the ink Ik in the external tank 72 to a level exceeding the supply pressure of the pressurization pump 20. The release valve 227 adjusts the supply pressure by releasing the pressurization force generated by the pressurizing portion 226 as needed. The CPU 240 controls operation of the pressurizing portion 226 and operation of the release valve 227 in accordance with a detection signal generated by the pressure detector 223. In this manner, the supply pressure of the ink Ik is set to a level equal to the pressure detected by the pressure detector 223.

In the sixth embodiment, the volume of the portion of the air detection tube 221 from the second air inlet port 75 to the pressure detector 223 corresponds to the volume of the space for detecting the air pressure. The volume of this portion is set to a value substantially equal to the volume of the space for receiving the pressurized air in the typical cartridge 18 (see FIG. 25).

Next, operation of the liquid supply apparatus 100 of the sixth embodiment will be explained.

When the liquid supply apparatus 100 of the sixth embodiment is received in the cartridge holder 17 as a replacement of the typical cartridges 18 (see FIG. 25), the pressure adjusting portion 225 supplies the ink Ik to the recording head 15 by the supply pressure corresponding to the air pressure set by the printer 10. An ink pressurization supply system provided by the liquid supply apparatus 100 is thus compatible with the ink pressurization supply system (the liquid pressurization supply system) provided by the pressurization pump 20 of the printer 10. This ensures normal operation of the printer 10.

That is, replaceability between the ink pressurization supply system of the cartridge 18 and the ink pressurization supply system of the liquid supply apparatus 100 is ensured. The ink Ik is thus supplied from the external tank 72 to the recording head 15, allowing the printer 10 to operate normally. Particularly, the pressure adjusting portion 225 supplies the ink Ik to the recording head 15 by the pressure equal to the air pressure generated by the pressurization pump 20 of the printer 10. Thus, the printing performance of the recording head 15 with the attachments 220 becomes equivalent to the printing performance of the recording head 15 with the typical cartridges 18. Further, the attachments 220 become usable simply by replacing the cartridges 18, without modifying the printer 10. This makes it possible to employ the large-capacity external tank 72 as an option.

Further, in the sixth embodiment, the pressure adjusting portion 225 detects the air pressure applied by the pressurization pump 20 through the second air inlet port 75 by means of the pressure detector 223. The supply pressure of the ink Ik is adjusted in accordance with the detected pressure. The supply pressure of the ink Ik is thus accurately controlled.

Controlling of the air pressure by the printer 10 is executed based on operation with the typical cartridges 18. Thus, if the volume of the space from the second air inlet port 75 to the pressure detector 223 is greatly different from the volume of the space for introducing the pressurized air in each cartridge 18, erroneous detection of a problem may occur in the printer 10. However, in the sixth embodiment, since the volumes of these spaces are substantially equal to each other, such problem detection is avoided, allowing the printer 10 to operate stably.

Next, an example of the pressure adjusting portion 225 that adjusts the supply pressure of the ink Ik, which is supplied from the external tank 72 of the liquid supply apparatus 100 to the second liquid outlet port 54 of each attachment 220, will be explained. As the pressure adjusting portion 225, the different structures shown in FIGS. 13 to 15, 22, and 23 may be employed.

Figure 22:
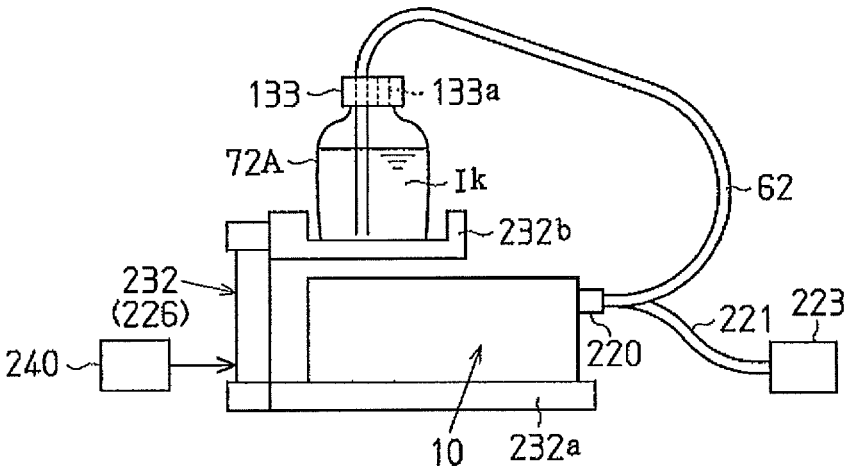
FIG. 22 is a schematic view showing an example of a pressure adjusting portion of FIG. 19.

In FIG. 22, a lift device 232 functions as the pressurizing portion 226. The lift device 232 has a base 232*a* on which the external tank 72 is mounted and a movable portion 232*b* on which the external tank 72 is mounted. The external tank 72 is located higher than the attachment 220.

In this pressure adjusting portion 225, the position liquid head corresponding to the difference between the level of the ink Ik in the external tank 72 and the level of the ink Ik in the attachment 220 is supplied to the second liquid outlet port 54 of the attachment 220. This structure makes it unnecessary to provide power to generate the supply pressure.

The height of the external tank 72 is adjustable by means of the lift device 232. Through such adjustment, the extent of the position liquid head, which acts as the supply pressure of the ink Ik, is regulated.

Thus, by operating the lift device 232 in correspondence with an output of the pressure detector 223, the CPU 240 adjusts the supply pressure of the ink Ik to a level equal to the air pressure generated by the pressurization pump 20. The printing performance of the recording head 15 with the attachments 220 thus becomes equivalent to that of a case with the typical cartridges 18.

In FIG. 13, the air pump 134 functions as the pressurizing portion 226. In this pressure adjusting portion 225, the supply pressure of the ink Ik sent to the second liquid outlet port 54 of the attachment 220 is ensured by the air pressure that acts to send the ink Ik out from the external tank 72. Supply of the supply pressure is thus easily suspended or adjusted by controlling operation of the air pump 134.

Also in FIG. 14, the air pump 134 functions as the pressurizing portion 226. This pressure adjusting portion 225 also ensures generation of the supply pressure of the ink Ik without providing a difference between the height of the external tank 72 and the height of each attachment 220. Further, the supply of the supply pressure is easily suspended or adjusted by controlling the operation of the air pump 134.

In FIG. 15, the liquid pump 137 functions as the pressurizing portion 226. In this pressure adjusting portion 225, the supply pressure of the ink Ik is generated by the pressure of the liquid pump 137 that acts to send the ink Ik out from the external tank 72. Thus, by controlling operation of the liquid pump 137, supply of the supply pressure is easily suspended or adjusted. Further, through such controlling, the supply pressure of the ink Ik can be adjusted to the level equal to the air pressure of the pressurization pump 20, which is introduced through the second air inlet port 75. The resulting printing performance of the printer 10 thus becomes equivalent to the printing performance of the case with the typical cartridges 18.

Figure 23:
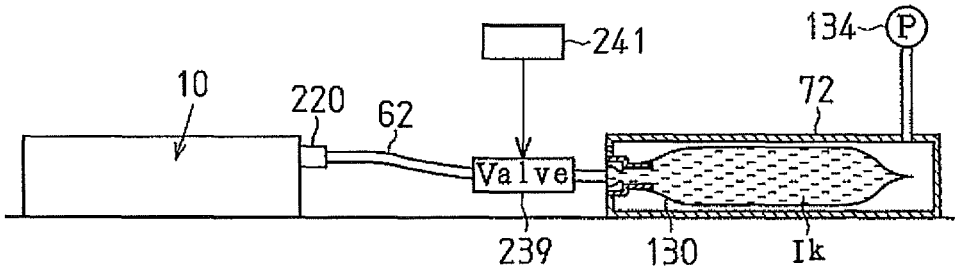
FIG. 23 is a schematic view showing a modified embodiment of the pressure adjusting portion.
Figure 24:
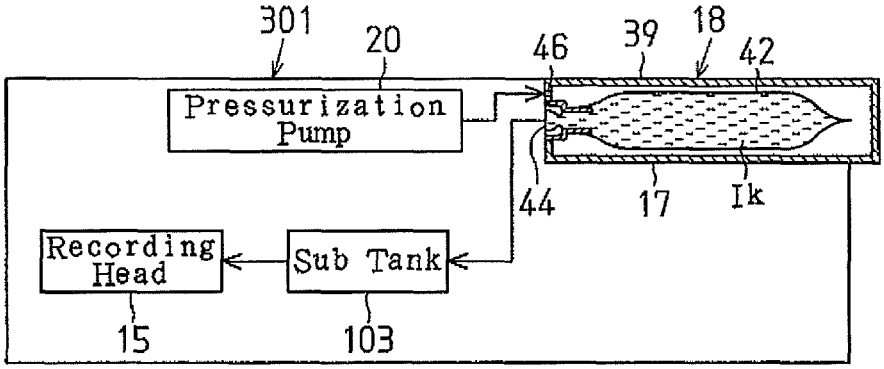
Fig. 24 (Prior Art)
FIG. 24 is a block diagram schematically representing a typical inkjet recording apparatus.

In FIG. 23, the air pump 134 functions as the pressurizing portion 226. The ink pack 130 is received in the external tank 72 formed of hard material. The air pump 134 introduces fluid pressure such as air pressure into the external tank 72, thus sending the ink Ik from the ink pack 130 to the second liquid outlet port 54 of the attachment 220. The pressure adjusting portion 225 includes a valve 239 and a valve control section 241. The valve 239 is arranged in the corresponding ink tube 62, which is a pressurization supply passage extending from the external tank 72 to the second liquid outlet port 54 of the attachment 220. The valve control section 241 controls operation of the valve 239 so that the supply pressure of the ink Ik becomes equal to the air pressure generated by the pressurization pump 20, which is introduced through the second air inlet port 75. The CPU 240 functions also as the valve control section 241.

The air pump 134 sends the ink Ik from the external tank 72 to the second liquid outlet port 54 of the attachment 220 by pressure greater than the pressure generated by the pressurization pump 20.

The pressure detector 223 detects the air pressure introduced from the pressurization pump 20 of the printer 10 through the second air inlet port 75 of the attachment 220 and the air detection tube 221. By controlling operation of the valve 239 in correspondence with the pressure detected by the pressure detector 223, the valve control section 241 adjusts the supply pressure of the ink Ik, which is supplied from the external tank 72 to the second liquid outlet port 54 of the attachment 220.

In this pressure adjusting portion 225, supply of the supply pressure of the ink Ik is easily suspended or adjusted by the valve control section 241 that controls operation of the valve 239. Further, through such controlling, the supply pressure of the ink Ik is adjusted to the level equal to the air pressure introduced from the pressurization pump 20 through the second air inlet port 75. The resulting printing performance of the printer 10 thus becomes equivalent to the printing performance of the case with the typical cartridges 18.

Also, the valve control section 241 may adjust the supply pressure of the ink Ik, which is supplied from the external tank 72 to the second liquid outlet port 54 of the attachment 220, by controlling the operation of the valve 239 directly by the air pressure produced by the pressurization pump 20 of the printer 10, for example.

In the liquid supply apparatus according to the present invention, the air inlet port, the liquid outlet port, the first air inlet port, the attachments, the external tank, the pressure adjusting portion are not restricted to the configurations of the illustrated embodiments. It is to be understood that these components may be configured in different forms based on the intent of the invention.

For example, in the illustrated embodiments, the liquid cartridges have been explained as the cartridges of the inkjet recording apparatus (the printer) by way of example. However, it is to be understood that the present invention is applicable to different liquid cartridges that supply different liquids to liquid ejecting portions. The liquids include color material used by a color filter manufacturing apparatus, electrode material (conductive paste) for forming electrodes of organic EL displays or FEDs, and biological organic material used by a biochip manufacturing apparatus.

It should be apparent to those skilled in the art that the present invention may be embodied in many other specific forms without departing from the spirit or scope of the invention. Therefore, the present invention is not to be limited to the details given herein, but may be modified within the scope and equivalence of the appended claims.

The invention claimed is:

1. A liquid supply system for use with a liquid ejection apparatus which includes a mounting portion including a liquid inlet portion, the mounting portion being stationary at a front side of the liquid ejection apparatus, the front side defining the side through which a paper is fed out in a sub scanning direction, the liquid supply system comprising:

an attachment that is configured to be mountable on the mounting portion, the attachment including a liquid outlet port located at the liquid inlet portion side of the mounting portion, and a wall at an apparatus front side opposite to the liquid inlet portion side of the attachment, when the attachment is mounted on the mounting portion, the wall having an inlet port, the attachment being configured to be mounted on the mounting portion such that the liquid ejection apparatus is configured to eject liquid while the attachment is mounted on the mounting portion;

an external tank for storing a liquid to be supplied to the attachment;

a liquid supply passage connecting the liquid outlet port of the attachment with the external tank through the inlet port of the wall at the apparatus front side of the attachment, the liquid supply passage having a tube extending into the attachment, the tube being connected to the liquid outlet port of the attachment located at the liquid inlet portion of the mounting portion; and a liquid retainer, wherein the attachment and liquid retainer are configured such that the attachment can be mounted on the mounting portion when the liquid retainer is detached from the mounting portion and the liquid retainer can be mounted on the mounting portion when the attachment is detached from the mounting portion, wherein the mounting portion, to which the attachment is configured to be mounted, is provided in a fixed manner on a frame member of the liquid ejection apparatus.

2. The liquid supply system for use with a liquid ejection apparatus according to claim 1, wherein the external tank is located at a position higher than the attachment.

3. The liquid supply system for use with a liquid ejection apparatus according to claim 2, further comprising an external waste liquid tank connected to the liquid ejection apparatus.

4. The liquid supply system for use with a liquid ejection apparatus according to claim 3, wherein the external waste liquid tank is located at a position lower than the attachment.

5. The liquid supply system for use with a liquid ejection apparatus according to claim 1, further comprising a valve provided in the liquid supply passage between the external tank and the liquid outlet port of the attachment.

6. The liquid supply system for use with a liquid ejection apparatus according to claim 2, wherein the external tank includes an air port, through which the external tank receives the air.

7. The liquid supply system for use with a liquid ejection apparatus according to claim 1, further comprising an external waste liquid tank connected to the liquid ejection apparatus.

8. The liquid supply system for use with a liquid ejection apparatus according to claim 7, wherein the external waste liquid tank is located at a position lower than the attachment.

9. A liquid supply system for use with a liquid ejection apparatus which includes a mounting portion including a liquid inlet portion, the liquid supply system comprising:

an attachment that is configured to be mountable on the mounting portion, the attachment including a liquid outlet port located at the liquid inlet portion side, and a wall opposite to the liquid inlet portion side when mounted on the mounting portion, the wall having an inlet port, the attachment being configured to be mounted on the mounting portion such that the liquid ejection apparatus is configured to eject liquid while the attachment is mounted on the mounting portion;

an external tank located higher than the attachment and configured to store a liquid to be supplied to the attachment;

a liquid supply passage connecting the liquid outlet port of the attachment with the external tank through the inlet port of the wall, the liquid supply passage having a tube extending into the attachment, the tube being connected to the liquid outlet port of the attachment located at the liquid inlet portion of the mounting portion; and a liquid retainer, wherein the attachment and liquid retainer are configured such that the attachment can be mounted on the mounting portion when the liquid retainer is detached from the mounting portion and the liquid retainer can be mounted on the mounting portion when the attachment is detached from the mounting portion, wherein the mounting portion, to which the attachment is configured to be mounted, is provided in a fixed manner on a frame member of the liquid ejection apparatus.

* * * * *